US006578945B2

(12) United States Patent
Hashi et al.

(10) Patent No.: US 6,578,945 B2
(45) Date of Patent: Jun. 17, 2003

(54) PRINTER FOR PRINTING BY DISCHARGING INK DROPLETS FROM A PLURALITY OF NOZZLES, AND WHOSE INK DISCHARGE SURFACE CAN BE EASILY RECOVERED

(75) Inventors: Hiroshi Hashi, Tokyo (JP); Toshihiro Kitahara, Tachikawa (JP)

(73) Assignee: Olympus Optical Co., Ltd., Tokyo (JP)

( * ) Notice: Subject to any disclaimer, the term of this patent is extended or adjusted under 35 U.S.C. 154(b) by 0 days.

(21) Appl. No.: 09/973,319

(22) Filed: Oct. 9, 2001

(65) Prior Publication Data

US 2002/0044168 A1 Apr. 18, 2002

(30) Foreign Application Priority Data

Oct. 13, 2000 (JP) ..... 2000-314329

(51) Int. Cl.[7] ..... B41J 2/165
(52) U.S. Cl. ..... 347/22; 347/32
(58) Field of Search ..... 347/22, 29, 30, 347/23, 33, 32, 104; 346/134

(56) References Cited

U.S. PATENT DOCUMENTS 5,040,000 A * 8/1991 Yokoi ..... 347/30
5,534,897 A * 7/1996 Anderson et al. ..... 347/32
6,000,776 A * 12/1999 Suzuki et al. ..... 347/19
6,293,645 B1 * 9/2001 Kim ..... 347/23
6,293,648 B1 * 9/2001 Anderson ..... 347/29

FOREIGN PATENT DOCUMENTS

JP 2000-168109 A 6/2000

* cited by examiner

*Primary Examiner*—Shih-wen Hsieh
(74) *Attorney, Agent, or Firm*—Frishauf, Holtz, Goodman & Chick, P.C.

(57) ABSTRACT

A printer is provided which includes a printer head disposed above a transportation belt, a paper attraction apparatus, and an ink discharge surface recovery apparatus. In order to conduct recovery treatment of an ink discharge surface, the transportation belt is retractable and the recovery apparatus is inserted into the gap formed between the printer head and transportation belt in a direction perpendicular to a paper transportation. In the inserted state, ink is discharged from the ink discharge surface toward a cap of the recovery apparatus, the clogged state of the nozzle is eliminated, and recovery treatment is completed. The recovery apparatus is thereafter retracted to the side of transportation belt. With this structure, the recovery treatment of the ink discharge surface can be easily conducted, an increase in the printer size is avoided, and adjustment, maintenance, and control can be easily conducted.

13 Claims, 17 Drawing Sheets

PRINTER FOR PRINTING BY DISCHARGING INK DROPLETS FROM A PLURALITY OF NOZZLES, AND WHOSE INK DISCHARGE SURFACE CAN BE EASILY RECOVERED

This application claims benefit of Japanese Application No. 2000-314329 filed in Japan on Oct. 13, 2000, the contents of which are incorporated by this reference.

BACKGROUND OF THE INVENTION

1. Field of the Invention

The present invention relates to the structure of a printer conducting printing by discharging ink droplets from a plurality of nozzles.

2. Description of the Related Art

The so-called ink-jet printers conducting printing by discharging fine ink droplets from a plurality of nozzles, which have been employed as printers for consumer applications, are typically the printers of a head scanning type in which printing is conducted by scanning a head in the main scanning direction (paper width direction). Printer heads employed in such printers of a head scanning type comprise a plurality of nozzles aligned in the same direction as the auxiliary scanning direction (paper feed direction) or at an angle thereto, and the printing along the entire paper width is conducted by scanning such printer head in the main scanning direction.

Therefore, a paper feed mechanism and a scanning drive mechanism for scanning the printer head in the main scanning direction were required as the feed drive mechanisms, the drive mechanism unit had a complex structure, and a limitation was placed on possible increase in printing speed.

Accordingly, full-line ink-jet printers requiring no drive for a printer head in the main scanning direction apparently make it possible to simplify the drive mechanism unit and to increase the printing speed. The full-line ink-jet printers have a full-line head with a printing width equal to the paper width, and printing is conducted in one pass. Since printing is conducted simultaneously for each one line in the paper width direction, absolutely no head scanning is required and printing can be conducted line by line, while continuously or intermittently transporting the paper sheet in one direction.

The full-line ink-jet printers have a printer head for printing on the entire width of a paper sheet in one pass, but a recovery apparatus for ink discharge surface is required for constantly preventing clogging and maintaining a good state of ink discharge surfaces of nozzles in a plurality of channels.

However, because the number of nozzles in the conventional ink-jet printers of a full-line printing system was very large, the space taken by the discharge surface recovery apparatus was significant. Moreover, in order to clean reliably the entire ink discharge surface, a complex drive system should be employed. For those reasons, the size increase of the printers cannot be avoided and cost effectiveness thereof is degraded.

Moreover, the position of nozzles in the conventional inkjet printers of a full-line printing system has to be arranged accurately, but when a printer head is composed of several blocks, even simple arrangement of the printer head requires complex alignment, maintenance and control are difficult, and merchandizing is also difficult.

SUMMARY OF THE INVENTION

The present invention was created to resolve the above-described problems and it is an object of the present invention to provide a printer for printing by discharging ink droplets from a plurality of nozzles, wherein the ink discharge surface is easily recovered, the recovery means has a simple structure, the increase in the printer size is avoided, the printer cost can be reduced, and the adjustment, maintenance, and control are easy to conduct.

The printer in accordance with the present invention, in which printing is conducted by discharging ink droplets from a plurality of nozzles, comprises a printer head which can conduct full-line printing on a printing paper, without scanning in the width direction of the printing paper, this printer head being provided with a plurality of nozzles, paper transportation means for transporting the printing paper in the transportation direction perpendicular to the width direction of the printing paper, this means having an endless transportation belt, supporting the printing paper, and being disposed opposite the ink discharge surface of the printer head, printing control means for conducting printing by controlling the discharge of fine ink droplets from the printer head synchronously with the printing paper transportation operation of paper transportation means, and recovery means for recovery of discharge function of nozzles of the printer head, this means being insertable and retractable with respect to the printer head in the lateral direction perpendicular to the transportation direction and parallel to the transportation surface of the transportation belt which supports the printing paper.

When recovery is conducted in the above-described printer, the discharge function of the nozzles is recovered by discharging the ink from the nozzles of the printer head in a state in which recovery means is inserted in the position opposite the printer head, or by causing suction of the ink with the recovery apparatus.

Other objects and advantages of the present invention will become evident from the following description.

DESCRIPTION OF THE PREFERRED EMBODIMENTS

The preferred embodiments of the present invention will be described below with reference to the drawings.

Figure 1:
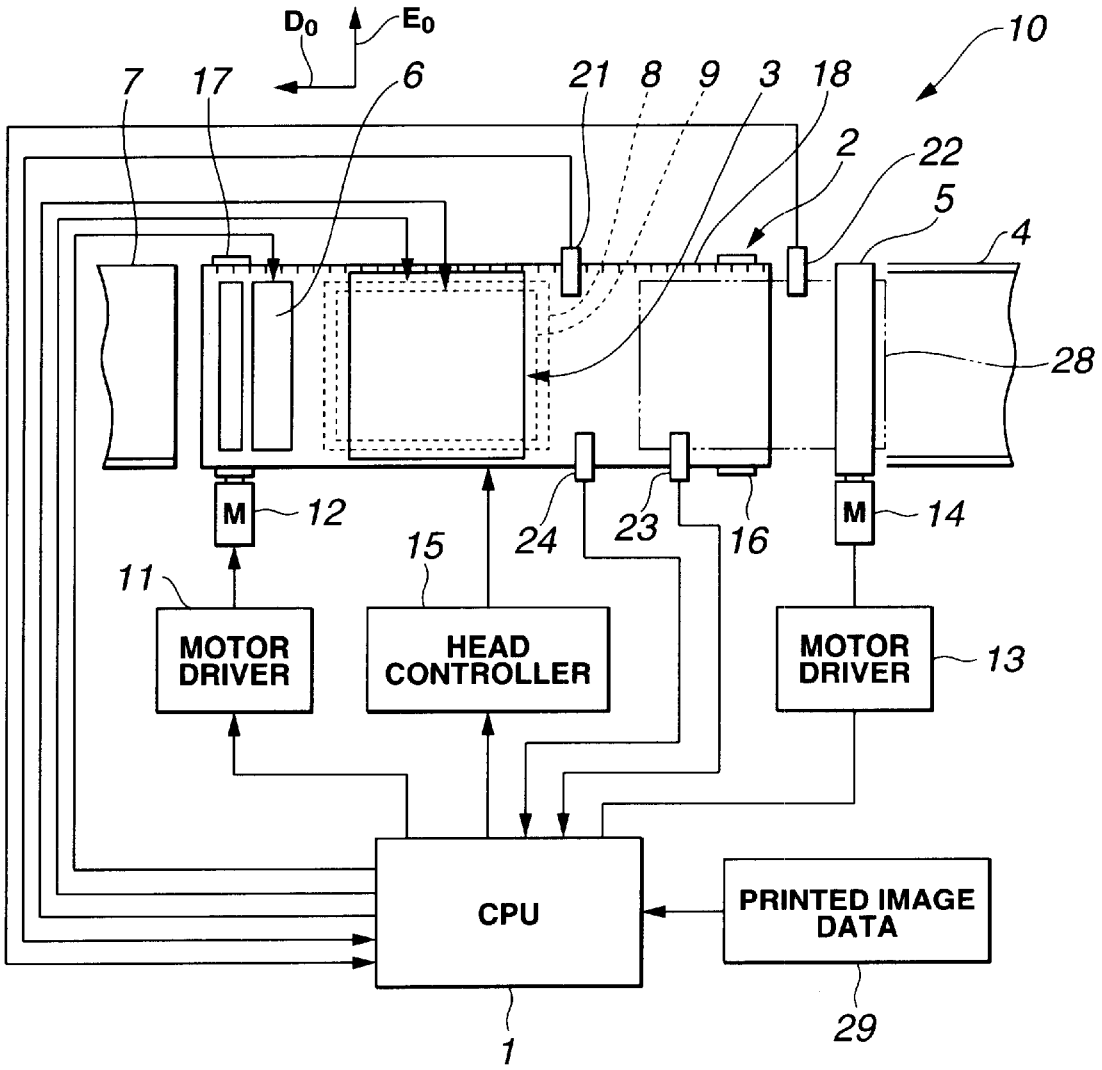
FIG. 1 is a system diagram of the printer which is the first embodiment of the present invention.
Figure 2:
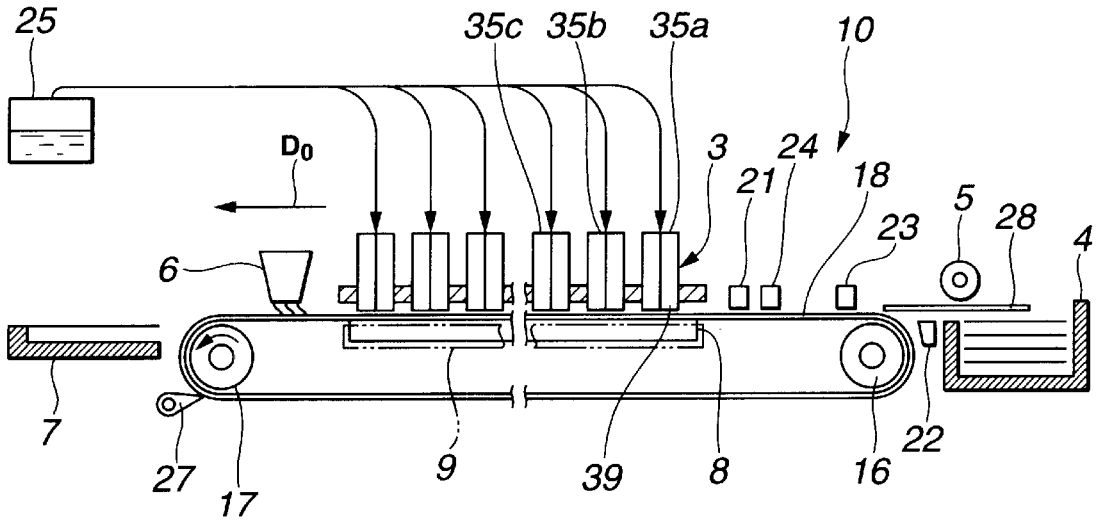
FIG. 2 is a longitudinal sectional view schematically illustrating the printing unit of the printer shown in FIG. 1.
Figure 3:
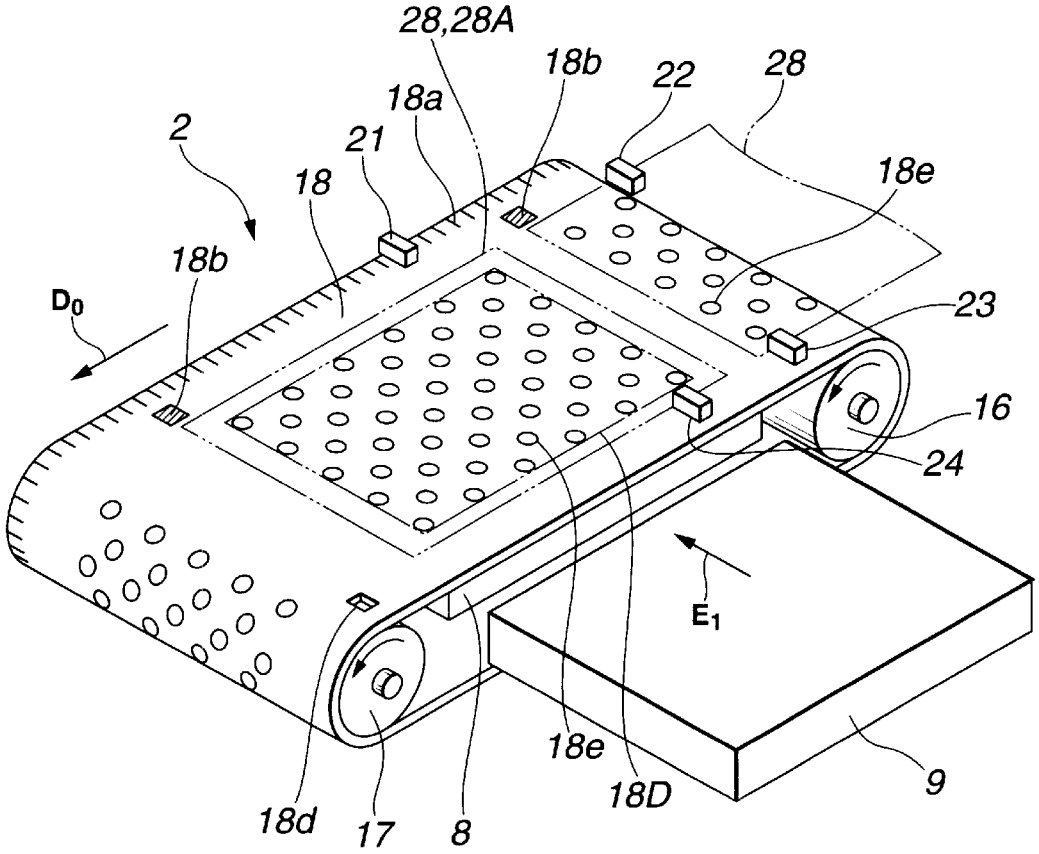
FIG. 3 is a perspective view illustrating the structure of the transportation system employed in the printer shown in FIG. 1.
Figure 4:
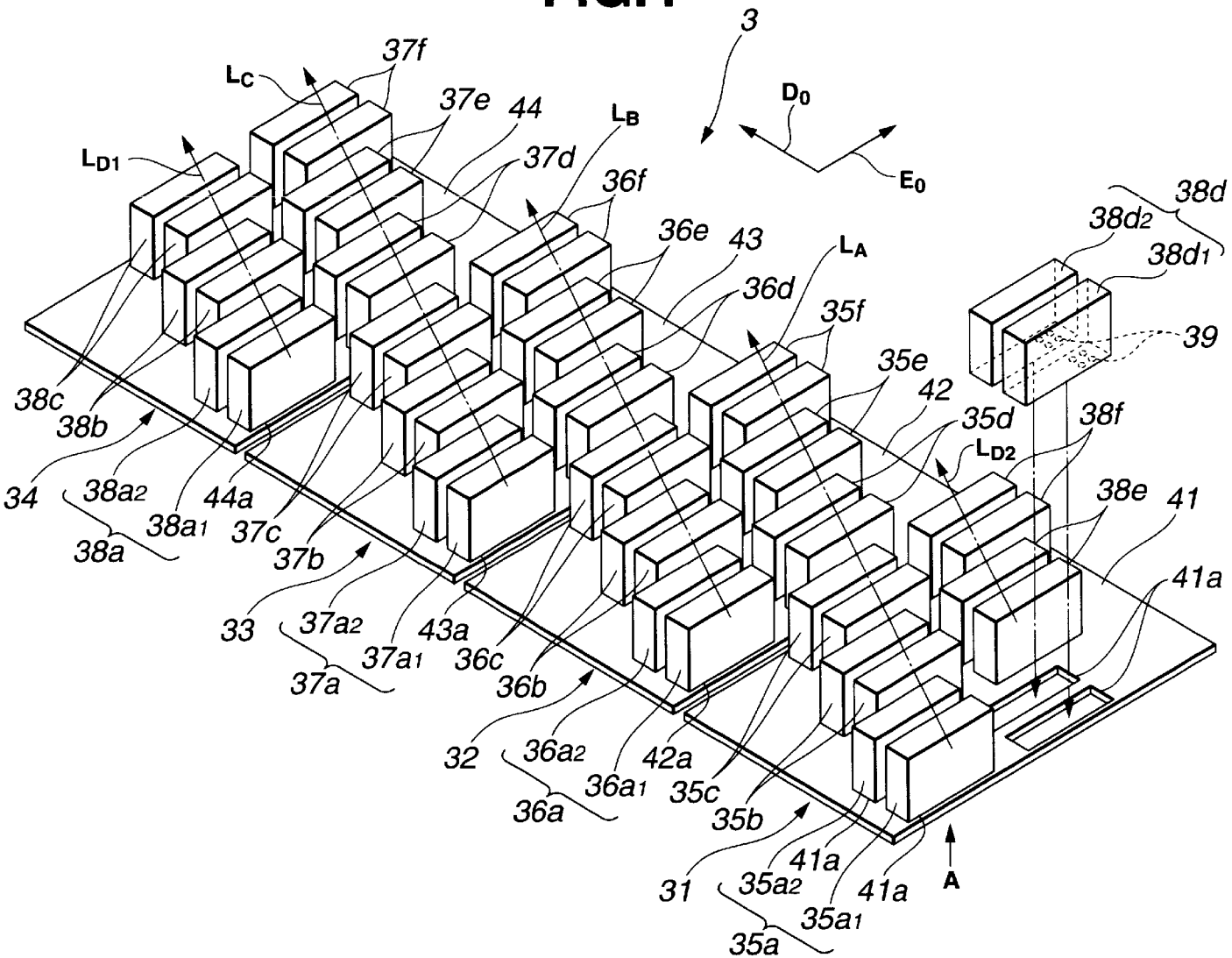
FIG. 4 is an exploded perspective view of the printer head employed in the printer shown in FIG. 1.
Figure 5:
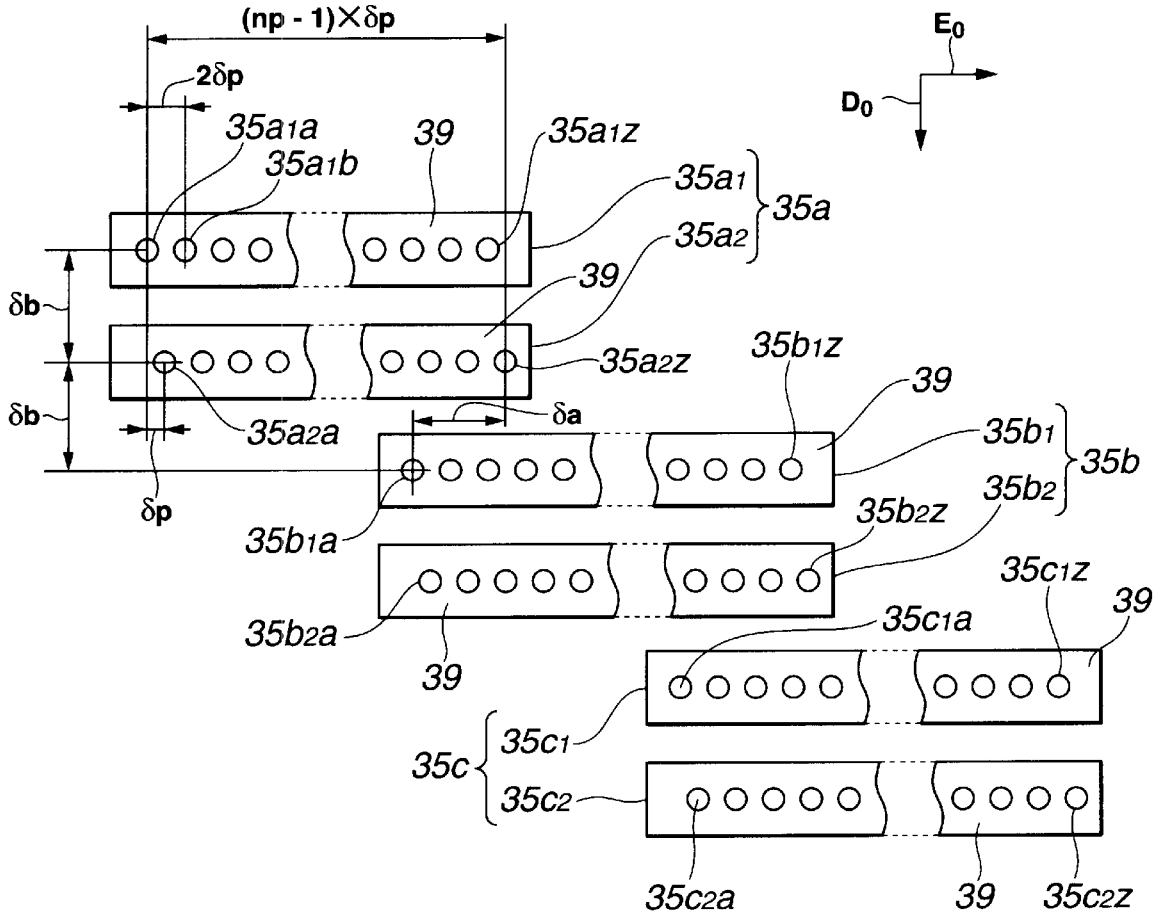
FIG. 5 is an expanded view, as viewed from the side of ink discharge surface (side A in FIG. 4), illustrating the arrangement of nozzles in the head unit constituting the printer head employed in the printer shown in FIG. 1.

FIG. 1 is a basic system diagram of a printer 10 illustrating the first embodiment of the present invention. FIG. 2 is a longitudinal section schematically illustrating the printing unit of printer 10. FIG. 3 is a perspective view illustrating the structure of a paper transportation system employed in printer 10. FIG. 4 is an exploded perspective view of a printer head employed in printer 10. FIG. 5 is an expanded view, as viewed from an ink discharge surface (side A in FIG. 4), illustrating the nozzle arrangement in a head unit constituting the printer head.

The printer 10 is an ink-jet printer conducting printing by discharging fine ink droplets from a plurality of nozzles arranged along the entire width of a paper sheet. The printer 10 comprises a CPU 1 which is printing control means for controlling the entire printer, a paper transportation system 2 which is paper transportation means having a transportation belt 18 for paper transportation, a printer head 3 for discharging ink droplets of four colors based on the printing image data, a paper feed tray 4 for feeding printing paper (referred to as paper hereinbelow) disposed upstream (feed side) of transportation belt 18, a feed roller 5 which is paper feed means disposed in the outlet opening of the paper feed tray 4, a drying apparatus 6 which is drying means of an air drying system disposed downstream (release side) of transportation belt 18, a paper release tray 7 for receiving the printed paper, which is disposed in the release portion of transportation belt 18, an attraction apparatus 8 which is attraction means for suction of paper 28 via pneumatic pressure, a recovery apparatus 9 which is recovery means for conducting a discharge function recovery treatment of printer head 3, a drive motor (M) 12 for drive roller 17 of the paper transportation system 2, a motor driver 11 for driving the motor 12, a drive motor (M) 14 for feed roller 5, a motor driver 13 for driving motor 14, and a head controller 15 for controlling the discharge of ink droplets by printer head 3.

Attraction apparatus 8 can be inserted into or retracted from a position located below and opposite to printer head 3 on the inner side of transportation belt 18. Furthermore, recovery apparatus 9 can be inserted from the side of transportation belt 18, that is, from lateral direction of paper perpendicular to the transportation direction.

The paper transportation system 2 comprises the transportation belt 18 which is an endless band-like body, a drive roller 17 and an idle roller 16 for driving the transportation belt 18 in the transportation direction (D0) perpendicular to the lateral direction (E1) of paper 28, a cleaning catch 27 as cleaning means for removing the ink that adhered to the belt transportation surface, and a variety of sensors. An ink absorption roller or the like may also be used as cleaning means.

The transportation belt 18 is provided with a group of suction holes 18*e* for attraction of paper 28, marking lines 18*a* at the preset distance from each other which serve as speed and position marks for detecting the running speed and position of transportation belt 18, a paper front end position mark 18*b* which is a paper support position mark (paper positioning means).

Group of suction holes 18*e* are provided in suction region 18D in a range narrower than a paper region 28A where paper 28 is supported. Paper front end position mark 18*b* is provided according to the detection position of the below described paper front end position sensor 22 for positioning paper 28 in the paper region 28A (see FIG. 3).

The above-described paper transportation system 2 also comprises a belt speed and position detection sensor 21 for detecting the transportation speed and position of transportation belt 18 by detecting the passage of the mark lines 18*a*, a paper front end position sensor 22 which is paper positioning means for detecting the paper front end position mark 18*b*, and two paper tilting detection sensors 23, 24 for detecting the tilting of paper with respect to transportation direction (D0) in the supported state of paper 28.

The printer head 3 is a printer head of an ink-jet type and is composed of a plurality of head units 35*a*, 35*b* having groups of piezoelectric elements for ink discharge control and rows of nozzles for discharging ink droplets. The ink which is to be discharged is fed from an ink tank 25. Other details relating to the structure will be described hereinbelow with reference to FIGS. 4 and 5.

The detailed structure of printer head 3 will be described below. FIG. 4 is an exploded perspective view of the printer head. As shown in the figure, the printer head is composed of four head blocks 31, 32, 33, 34 disposed along the paper transportation direction (D0 direction). Each head block is composed of a support substrate and head units arranged in rows each containing three units at an angle tilted with respect to the D0 direction. Furthermore, each head unit consists of a pair of nozzle row units and incorporates piezoelectric elements discharging ink droplets.

Thus, head block 31 is composed of a head support substrate 41 and head units 35*a*, 35*b*, 35*c* and head units 38*d*, 38*e*, 38*f* held in openings 41*a* of head support substrate 41.

Head block 32 is composed of a head support substrate 42 and head units 36*a*, 36*b*, 36*c* and head units 35*d*, 35*e*, 35*f* held in openings 42*a* of head support substrate 42.

Head block 33 is composed of a head support substrate 43 and head units 37*a*, 37*b*, 37*c* and head units 36*d*, 36*e*, 36*f* held in openings 43*a* of head support substrate 43.

Head block 34 is composed of a head support substrate 44 and head units 38*a*, 38*b*, 38*c* and head units 37*d*, 37*e*, 37*f* held in openings 44*a* of head support substrate 44.

Head units 35*a*, 35*b*, 35*c*, 35*d*, 35*e*, 35*f* disposed so as to be divided between head block 31 and head block 32 are units for discharging black (B) ink and are arranged along a single tilted line LA which is tilted with respect to the D0 direction.

Head units 36*a*, 36*b*, 36*c*, 36*d*, 36*e*, 36*f* disposed so as to be divided between head block 32 and head block 33 are units for discharging yellow (Y) ink and are arranged along a single tilted line LB which is tilted with respect to the D0 direction.

Head units 37*a*, 37*b*, 37*c*, 37*d*, 37*e*, 37*f* disposed so as to be divided between head block 33 and head block 34 are units for discharging magenta (M) ink and are arranged along a single tilted line LC which is tilted with respect to the D0 direction.

Head units 38*a*, 38*b*, 38*c*, 38*d*, 38*e*, 38*f* disposed so as to be divided between head block 34 and head block 31 are units for discharging cyan (C) ink and are arranged along two tilted lines LD1 and LD2 which are tilted with respect to the D0 direction.

In the assembled state of printer head 3, in the above-described plurality of head units provided for different colors, for example, head units 35*a*, 35*b*, 35*c*, 35*d*, 35*e*, 35*f*, the respective nozzles of ink discharge are arranged at a preset tilting angle (for example, along the tilted line LA shown in FIG. 4) with respect to the D0 direction with a preset pitch δbp, except overlapping portions, in the effective printing width (210 mm in case of A4 format) in the E0 direction of paper 28. For example, in case of 400 dpi resolution, the pitch bp is 0.0635 mm.

FIG. 5 is an expanded view, as viewed from the ink discharge surface 39, of the three head units representing a portion of the head block. For example, in head block 31, the head unit 35*a* is composed of a pair of nozzle row units 35*a*1 and 35*a*2. Similarly, the head unit 35*b* is composed of a pair of nozzle row units 35*b*1 and 35*b*2. The head unit 35*c* is similarly composed of a pair of nozzle row units 35*c*1 and 35*c*2. Furthermore, the nozzle row units are arranged at a distance of 6*b* from each other in the D0 direction, including the nozzle row units of different head units.

On the ink discharge surface 39 of one nozzle row unit 35*a*1, np/2 nozzles 35*a*1*a*, 35*a*1*b*, . . . 35*a*1*z* are arranged with a pitch of 2δp in the E0 direction. On the ink discharge surface 39 of another nozzle row unit 35*a*2, np/2 nozzles 35*a*2*a*, 35*a*2*b*, . . . 35*a*2*z* are also arranged with a pitch of 2δp. Nozzles 35*a*2*a*, 35*a*2*b*, 35*a*2*z* are arranged so as to be shifted by a pitch δp with respect to respective nozzles 35*a*1*a*, 35*a*1*b*, . . . 35*a*1*z*. Therefore, in head unit 35*a* composed of a pair of nozzle row units 35*a*1 and 35*a*2, np dot nozzles are arranged with a pitch of δp.

Following the above-described head unit 35*a*, the nozzles provided in head unit 35*b* and then head unit 35*c* are disposed, as described above, so as to be spaced by a distance of δb in the D0 direction and to be shifted with respect to each other, in a state in which they overlap by a distance δa, in the E0 direction. The overlap distance δa corresponds to δa/δp fraction as the number of printing dots. Furthermore, head unit 35*d* of head block 32 is arranged in a similar relative position with respect to head unit 35*c*. Moreover, head unit 35*f* is arranged in a similar relative position with respect to head unit 35*d*, and head unit 35*e* is arranged in a similar relative position with respect to head unit 35*f*. Further, any amount of overlap may be set, provided that it is no less than one dot.

The recovery apparatus 9 is employed for conducting recovery treatment providing for recovery of ink droplet discharge function of head discharge surface 39 where nozzle rows of printer 3 are provided. For example, this apparatus is employed for releasing or preventing clogging. In the course of printing operation, the recovery apparatus 9 is retracted to the position at a side of transportation belt 18 and the recovery treatment is executed by moving the recovery apparatus 9 from outside in the E1 direction and feeding it above the transportation belt 18 and under the printer head.

The printing operation conducted in printer 10 having the above-described structure will be described below. First, when printing is initiated, the recovery treatment of the ink discharge surface of printer head 3 is executed with the recovery apparatus 9.

Then, transportation belt 18 is driven at a constant speed, while the passage of marking lines 18*a* provided equidistantly on belt 18 is being detected by belt speed-position sensor 21. When the paper front end position mark 18*b* of transportation belt 18 is detected by paper front end position detection sensor 22, the feed roller 5 is activated and paper 28 is fed to a position of paper region 28A on transportation belt 18. Paper 28 is supported in a position of paper region 28A by attraction apparatus 8 via group of suction holes 18*e* and is transported in the D0 direction together with transportation belt 18.

If the front end of paper 28 reaching the preset position under the printer head 3 is detected by detecting with the belt speed-position sensor 21 the number of passed marking lines 18*a* after the detection of the paper front end position mark 18*b*, then printing is initiated synchronously with the movement of transportation belt 18 in the D0 direction which is the paper traveling direction. Thus, when printing is executed, the discharge control of ink droplets of each nozzle over the entire region along the paper width per each color of printer head 3 is executed via the head controller 15 based on the printing image data 29.

When the speed of transportation belt 18 changes during printing, the discharge timing of ink droplets from nozzles of each head unit is adjusted by the belt speed-position sensor 21 via the head controller 15 and normal printing is continued.

When tilting (inclination) of holding position of paper 28 is detected by paper tilting detection sensors 23, 24, the ink droplet discharge timing or discharge nozzle position of nozzles in each head unit is controlled according to the inclination of paper and the ink discharge position on the paper is adjusted. Furthermore, when the inclination of paper of no less than the preset value is detected and the discharge timing cannot be corrected, the ink droplet discharge is interrupted and printing is terminated.

Once printing execution has been completed, drying of ink with drying apparatus 6 is conducted and then the attraction force of attraction apparatus 8 is reduced and paper 28 is placed into a release paper tray 7.

In printer head 3, as was described with reference to a drawing illustrating the nozzle arrangement in FIG. 5, the nozzles are arranged with a prescribed overlap in the E1 direction of paper width among the head units. Since ink droplets are double discharged in the overlapping portions, the density naturally becomes higher than in the original image data. Accordingly, the below-described correction control is applied to the discharge of ink droplets in the overlapping portions to provide for smooth printing with the same density as in the printing image data, without conspicuous head joints.

With printer 10 of the above-described first embodiment, scanning of printer head in the E0 direction (main scanning direction) typical for conventional ink-jet printers is not conducted. Therefore, the transportation speed of paper 28 can be increased. And printing speed can be raised. Furthermore, no mechanism is needed for driving the printer head in the E0 direction, the printer structure is simplified, the dimensions of printer can be decreased and its cost can be reduced.

Furthermore, printer head 3 corresponding to the paper width and having an assembly of a plurality of head units, rather than the long continuous and integrated printer head, was used as the printer head in the printer of the first embodiment. Therefore, the fabrication is simple and the assembly and adjustment can be easily conducted with the below described density distortion correction technology.

In the above-described printer head 3, head units were disposed along the line LA tilted with respect to the D0 direction for each color. Therefore, timing control of nozzles which are to discharge ink in the ink droplet discharge control is facilitated.

Since endless transportation belt 18 driven by the drive roller is employed as a paper transportation system, without using platen rollers and the like, the dimensions of the apparatus can be reduced without making the transportation mechanism more complex. Furthermore, since drive roller 17 is installed downstream in the transportation direction, a tension is constantly applied to the transportation belt at the paper transportation side and no deflection is formed. As a result, accurate paper transportation can be conducted.

Since pneumatic attraction apparatus 8 was employed for holding paper in the prescribed position, paper displacement and printing displacement can hardly occur. Furthermore, the suction region 18D where the group of suction holes 18*e* is provide on transportation belt 18 is narrower than the paper region 28A and no suction holes are provided outside the paper region. Therefore, accurate printing is conducted without air disturbance in the ink droplet discharge portion and without disrupting the ink discharge direction.

The above-mentioned ink droplet discharge correction and control technology designed for correcting the printing density changed by the aforesaid overlapping of nozzles is described in details in Japanese Patent Application Laid-open 2000-168109 (USP AP. No. 09/442417, filed on Nov. 18, 1999) filed earlier by the Assignee of the present application.

Printer head 3 employed in the above-described printer 10 uses a composite color head block in which head units of a plurality of colors (two colors) are disposed in one head block. As a modification, a multicolor printer head can also be composed by assembling monochromatic head block composed of a plurality of monochromatic head units.

Figure 6:
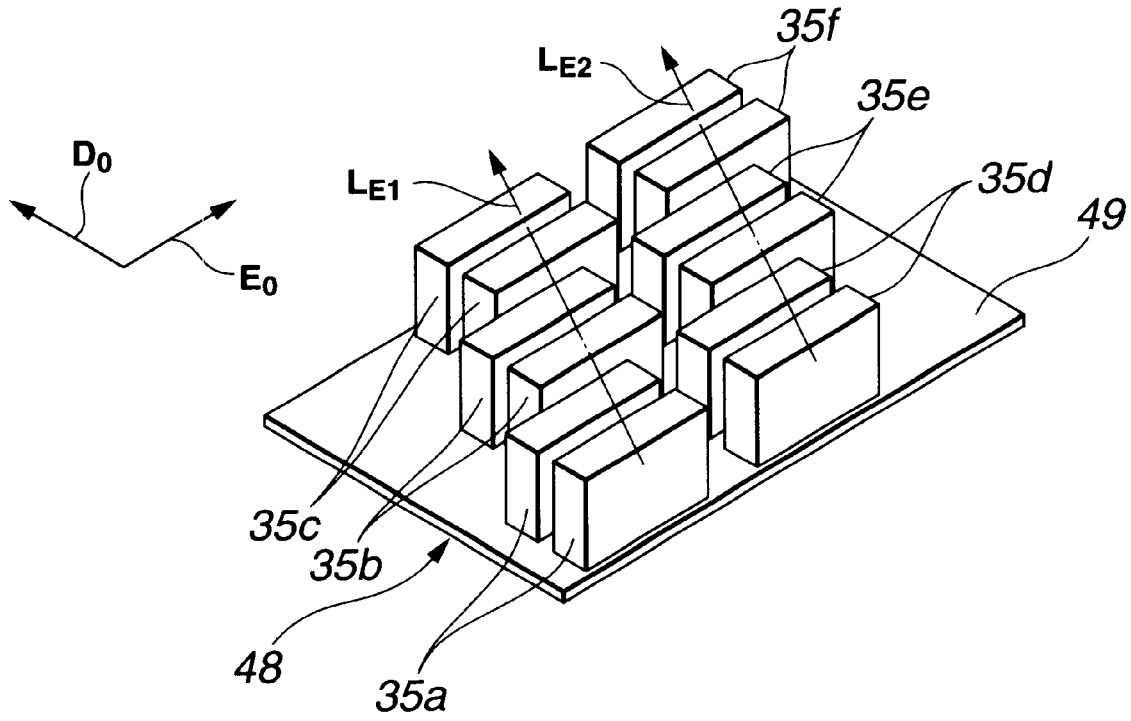
FIG. 6 is a perspective view of a B (black) head block as a modification of the printer head (head block) employed in the printer shown in FIG. 1.

FIG. 6 is a perspective view of a B (black) head block 48 serving as a monochromatic head block in the printer head of the aforesaid modification. In this B head block 48, black head units 35*a*, 35*b*, 35*c* are disposed along the tilted line LE1 tilted in the D0 direction and black head units 35*d*, 35*e*, 35*f* are disposed on a head support substrate 49 along a tilted line LE2 tilted in the D0 direction.

As for the relationship between relative positions of head units 35*a*, 35*b*, 35*c* and 35*d*, 35*e*, 35*f*, they are disposed in nozzles positions explained with reference to FIG. 5. However, head units 35*a* and 35*d* are disposed so that the nozzle position thereof is located on the line in the E0 direction. Moreover, the amount of overlapping of the nozzle positions of head units 35*c* and 35*d* in the E0 direction is equal to distance δa shown in FIG. 5. Furthermore, in the present modification, the explanation is conducted with respect to a black head block; head blocks of other colors have a similar structure.

The printer of the second embodiment of the present invention will be described below.

Figure 7:
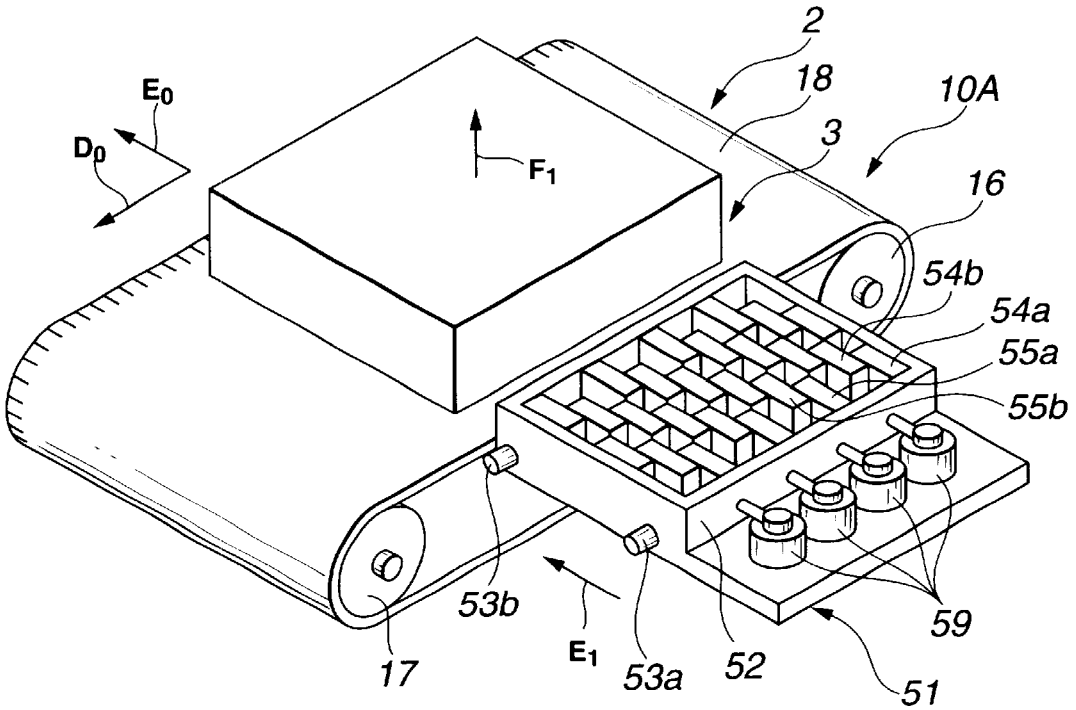
FIG. 7 is a perspective view illustrating the main portion of the printer which is the second embodiment of the present invention; this view relates to a state in which the recovery apparatus is retracted.
Figure 8:
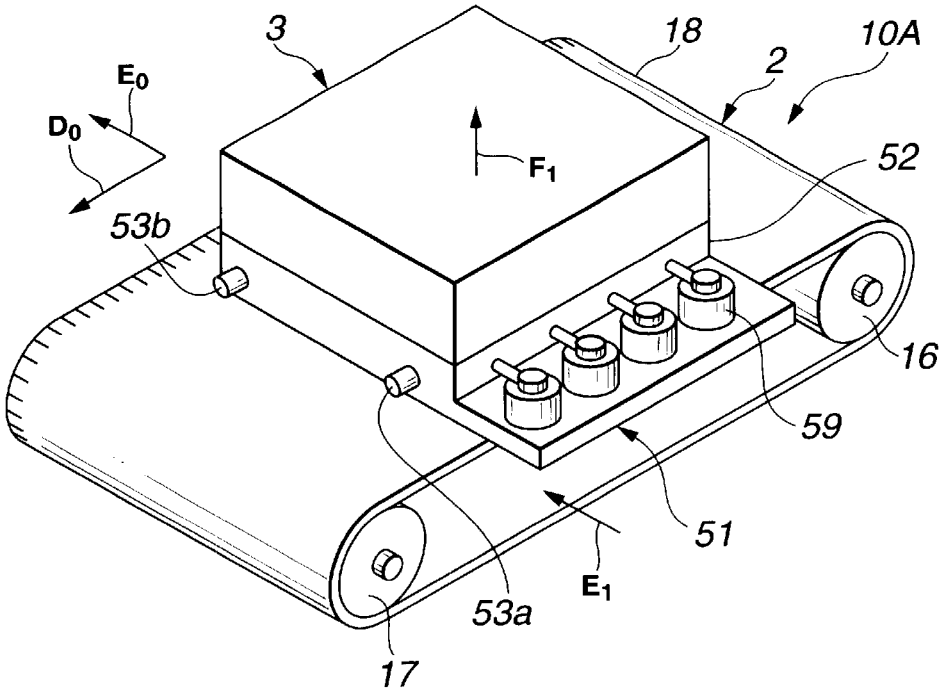
FIG. 8 is a perspective view illustrating the main portion of the printer shown in FIG. 7; this view shows a state in which the recovery apparatus is inserted under the printer head.

FIGS. 7, 8 are perspective views illustrating the main portion of printer 10A of the second embodiment. FIG. 7 illustrates a state in which the recovery apparatus is retracted in a printing stand-by mode or printing ready mode. FIG. 8 illustrates a state in which the recovery apparatus is inserted under the head and the recovery treatment is executed.

The printer 10A of the present embodiment has the following specific features. Thus, the printer head 3 can be moved with respect to printer 10 in the upward F1 direction of withdrawal from transportation belt 18. Further, a recovery apparatus 51 which is recovery means that can slide in the below-described E1 direction is provided at the transportation side of transportation belt 18 as recovery means. All other structural features are the same as described above. The above-mentioned E1 direction is the direction parallel to the E0 direction which is a paper width direction.

Recovery apparatus 51 has guide pins 53*a*, 53*b* and comprises a recovery apparatus body 52 that can slide in the E1 direction, caps 54*a*, 54*b*, 55*a*, 55*b* . . . installed inside the body 52 and serving as capping means corresponding to respective discharge surfaces of all head units 35*a*, 35*b*, 36*a*, 36*b* . . . of printer head 3, and a plurality of drain pumps 59 connected to the caps. In addition to capping means, means for wiping the discharge surfaces may also be employed.

In the printing operation state of printer 10A, the recovery apparatus 51 is retracted to the side of transportation belt, as shown in FIG. 7. When the recovery treatment of printer head surface is conducted, first, the printer head 3 is raised in the F1 direction of withdrawal from transportation belt 18. As shown in FIG. 8, recovery apparatus body 52 is slid in the E1 direction, as shown in FIG. 8, and moved in the position suitable for recovery treatment beneath the printer head 3 that is located above the upper surface of transportation belt 18.

When recovery apparatus 51 is in a state in which the recovery treatment can be conducted, ink is discharged from the ink discharge surface of printer head 3 into the caps and cleaning of clogged nozzles is conducted. The discharged ink is supplied into drain tank 26 (see FIG. 2) via a drain pump 59. When the recovery treatment is completed, recovery apparatus 51 is retracted into the position at the side of transportation belt 18 and printer head 3 is lowered and set into a printing position. When the printer is not used, the head unit surface is covered with the caps preventing the nozzles from drying out.

With printer 10A of this embodiment, when recovery treatment is conducted all of the ink discharge surfaces of printer head 3 can be cleaned at the same time and fast recovery treatment can be conducted. Furthermore, since recovery apparatus 51 is retracted from transportation belt 18 during printing, the paper transportation system 2 can be made compact and the dimensions of the printer can be reduced.

A printer of the third embodiment of the present invention will be described below.

Figure 9:
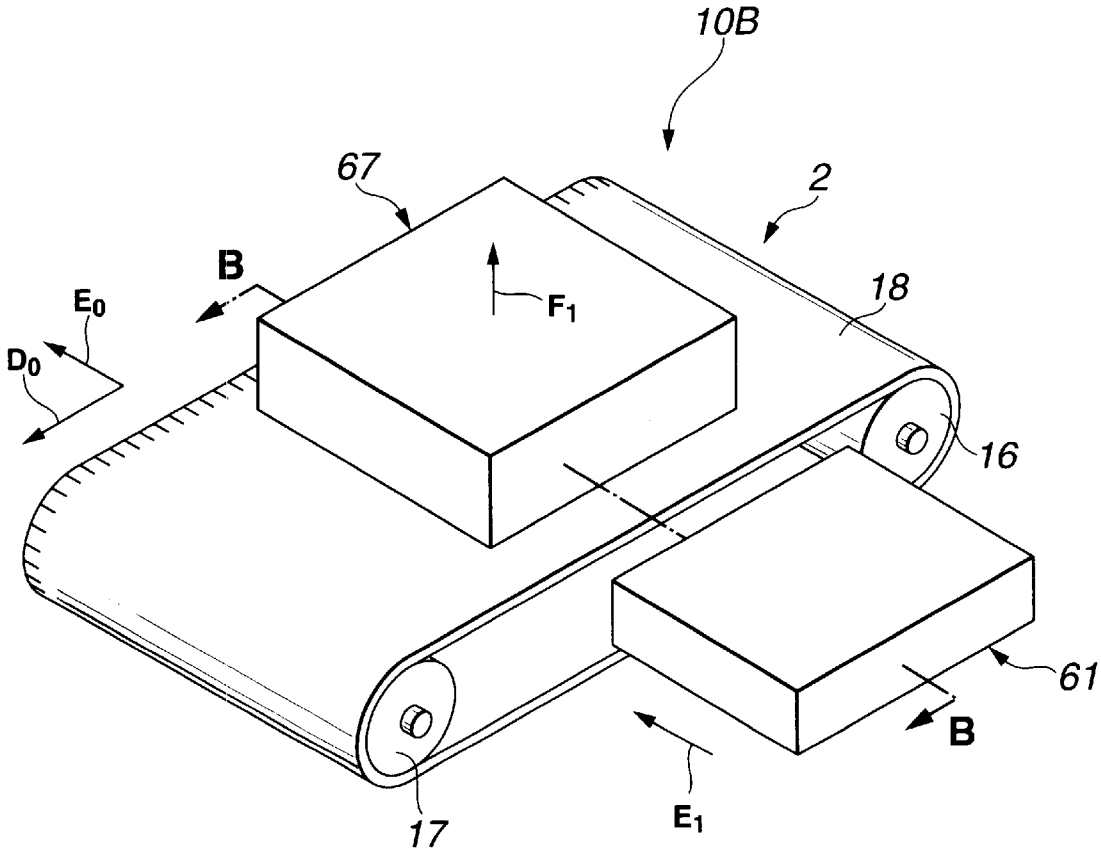
FIG. 9 is a perspective view illustrating the main portion of the printer of the third embodiment of the present invention; this view relates to a state in which the recovery apparatus is retracted.
Figure 10A:
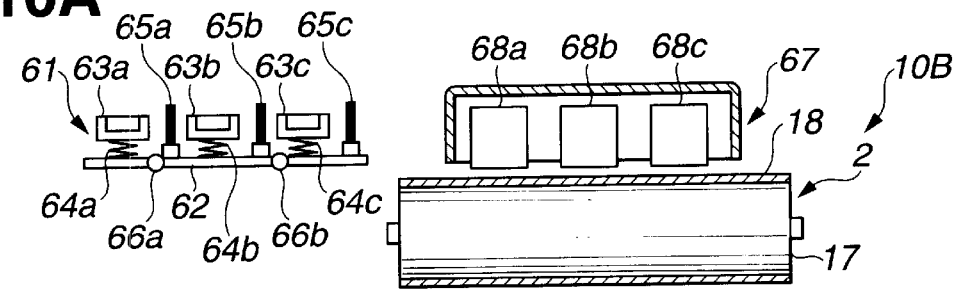
FIG. 10A is a cross-sectional view along B—B in FIG. 9; this view relates to a printing stand-by state of the printer shown in FIG. 9 or the printing operation state in which the recovery apparatus is retracted.
Figure 11:
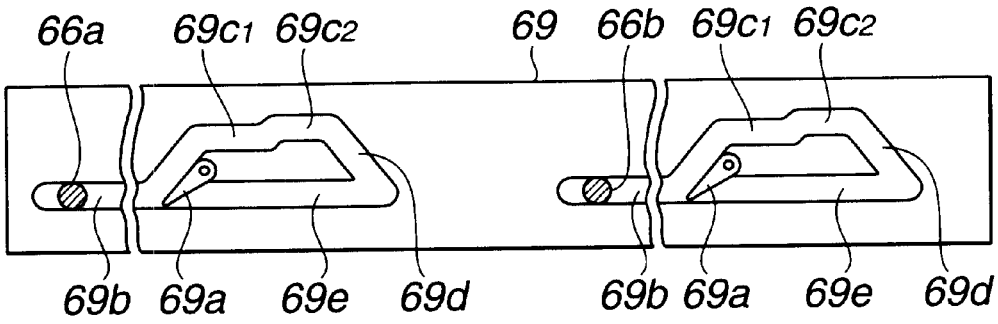
FIG. 11 is a side view illustrating the main portion of the guide plate of the recovery apparatus body employed in the recovery apparatus in the printer shown in FIG. 9.
Figure 12:
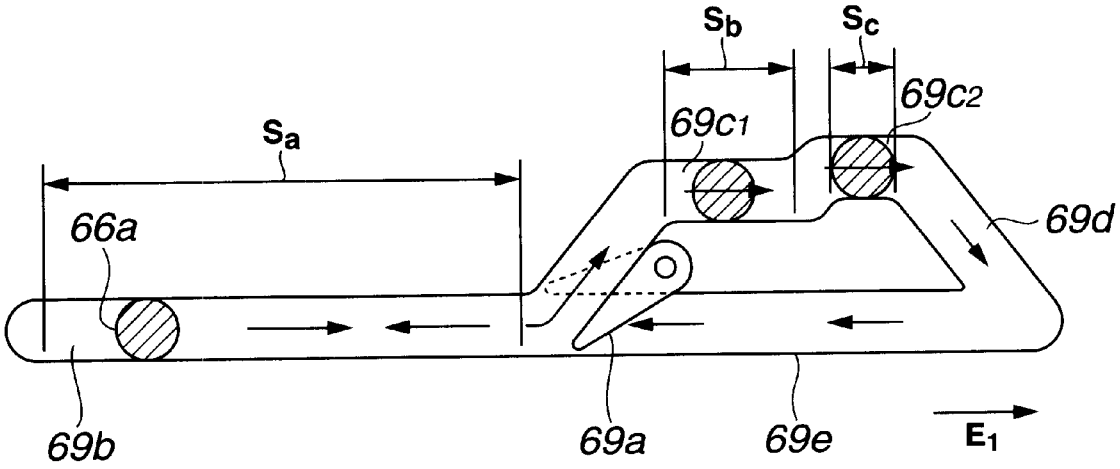
FIG. 12 illustrates a process of guiding with a guide plate of the recovery apparatus body of the recovery apparatus in the printer shown in FIG. 9.

FIG. 9 is a perspective view illustrating the main portion of the printer 10B of the third embodiment, illustrating a state in which the recovery apparatus is retracted. FIGS. 10A–10E are a B—B cross section in FIG. 9 and illustrate the operation process of recovery treatment. FIG. 10A illustrates a state in which the recovery apparatus is retracted in a printing stand-by mode or printing ready mode prior to recovery treatment. FIGS. 10B–10E illustrate various operation states of recovery treatment. FIG. 11 is a side view illustrating the main portion of a guide plate of the recovery apparatus body employed in the recovery apparatus. FIG. 12 is an expanded view illustrating the operation of a guide pin in a cam groove of the guide plate.

Printer 10B of the present embodiment has the following specific features. Thus, a printer head 67 can be moved with respect to printer 10 in the direction F1 of withdrawal from transportation belt 18, and a recovery apparatus 61 is provided which can be inserted and retracted by sliding in the E1 direction parallel to the paper width direction E0 perpendicular to the transportation direction D0 above transportation belt 18. All other structural features are the same as described above. The above-mentioned paper width direction E0 is the direction perpendicular to the paper transportation direction D0.

Recovery apparatus 61, which is recovery means, has guide pins 66*a*, 66*b* installed on both side surfaces perpendicular to the E1 direction and comprises a recovery apparatus body 62 that can slide in the E1 direction, a plurality of recovery units assembled on body 62 and disposed corresponding to head units 68*a*, 68*b*, 68*c* of printer head 67, and a guide plate 69 for guiding the apparatus body 62 via guide pins 66*a*, 66*b* (see FIG. 10A).

The plurality of recovery units are composed of cap members 63*a*, 63*b*, 63*c* which are flexible cap means that can cover the ink discharge surfaces of head units, spring members 64*a*, 64*b*, 64*c* acting upward upon the caps, and wipers 65*a*, 65*b*, 65*c* which are flexible wiping means for sliding in a state of elastic deformation and wiping the ink discharge surface (see FIG. 10A). The wipers are disposed adjacent to the respective caps at a side thereof in the E1 direction.

The guide plate 69 is supported with respect to the printer body so as to face both side surfaces perpendicular to the E1 direction. As shown in FIG. 11, there are provided two guide grooves 69*b*, 69*c*1, 69*c*2, 69*d*, 69*e* into which the guide pins 66*a*, 66*b* of apparatus body 62 are slidably inserted and two switch catches 69*a* which are rotatably installed in the branching portion of guide grooves 69*c*1 and 69*e*. A counterclockwise force is applied to switch catches 69*a* by springs (not shown in the figure) or by gravity.

Guide groove 69*b* forms a cam groove region Sa in which the guide pin 66*a* is supported in the lowermost position. The height of recovery apparatus 61 in this state is such that neither wipers 65*a*, 65*b*, 65*c* nor cap members 63*a*, 63*b*, 63*c* are brought in contact with the ink discharge surface. The effective length of the cam region Sa in the E1 direction is equivalent to the paper width and is the length through which recovery apparatus 61 is moved from a position outside the transportation belt to the vicinity of heads which are to be wiped with wipers.

Further, guide groove 69*c*l forms a cam groove region Sb in which the guide pin 66*a* is supported at a preset increased height. The height of recovery apparatus 61 in this state is such that wipers 65*a*, 56*b*, 65*c* are brought in contact with the ink discharge surface, but cap members 63*a*, 63*b*, 63*c* are not brought in contact with the ink discharge surface. The effective length of cam region Sb in the E1 direction is equivalent to the head width and is the length through which the wipers of recovery apparatus 61 move to wipe the ink discharge surface.

Guide groove 69*c*2 forms a cam groove region Sc in which guide pin 66*a* is supported at a preset increased height above guide groove 69*c*l. The height of recovery apparatus 61 in this state is such that both the wipers 65*a*, 56*b*, 65*c* and the cap members 63*a*, 63*b*, 63*c* are brought in contact with the ink discharge surface. The effective length of cam region Sc in the E1 direction is the length required to move the cap members into positions in which they cover the head discharge surface after wiping.

The cam grooves into which the guide pin 66*b* is fit have similar cam groove regions.

The recovery operation of printer 10B of the present embodiment having the above-described configuration will be described below with reference to FIGS. 10A–10E, 11, and 12.

Recovery apparatus 61 is guided and supported with guide plate 69 shown in FIG. 11 by means of two guide pins 66*a* and 66*b* on both side surfaces thereof and the apparatus body 62 moves parallel to itself.

When apparatus body 62 is in a retracted position (state shown in FIG. 10A), guide pins 66*a*, 66*b* are positioned in respective end portions of guide grooves 69*b* (outer side of cam groove section Sa).

Figure 10B:
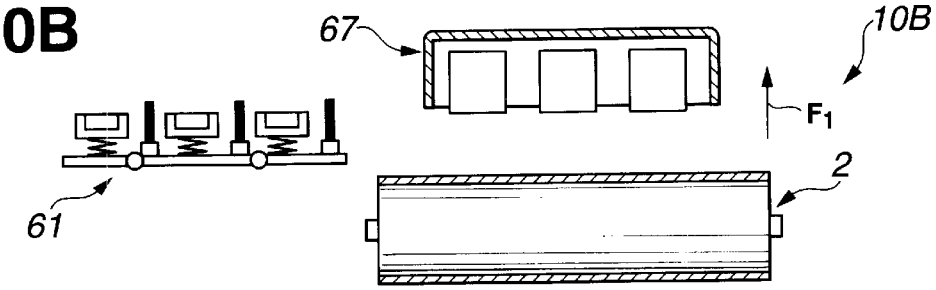
FIG. 10B is a cross-sectional view along B—B in FIG. 9; this view illustrates a state in which the printer head is raised to conduct the recovery of the printer shown in FIG. 9.

When the recovery treatment is executed, printer head 67 is raised to a preset height in the upward F1 direction (state shown in FIG. 10B.

Figure 10C:
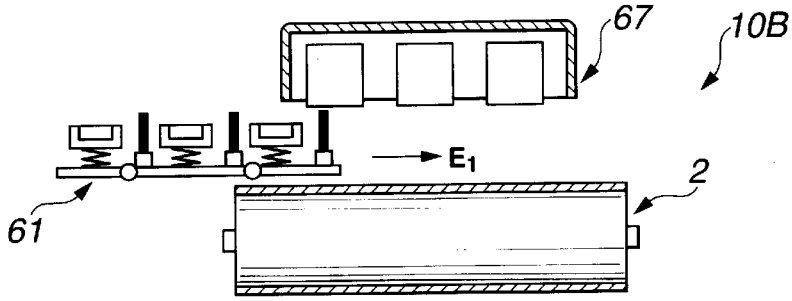
FIG. 10C is a cross-sectional view along B—B in FIG. 9; this view illustrates a state in which the recovery apparatus is inserted to conduct the recovery of the printer shown in FIG. 9.

Here, apparatus body 62 of recovery apparatus 61 is moved in the E1 direction, while being guided by guide plate 69 toward a gap formed between printer head 67 and transportation belt 18 (state shown in FIG. 10C). As a result of this movement, guide pins 66*a*, 66*b* are brought in contact with guide pin switch catches 69*a*, guided upward along the tilted line, moved upward in a parallel fashion and reach the end position of cam groove region Sb of guide groove 69*c*l. In this state, the front ends of wipers 65*a*, 65*b*, 65*c* are brought in contact with the ink discharge surface (state shown in FIG. 10D).

Figure 10D:
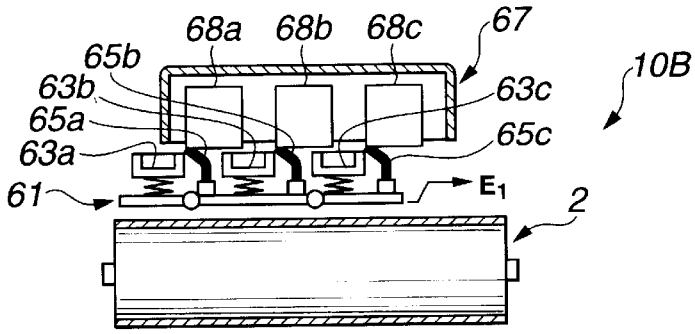
FIG. 10D is a cross-sectional view along B—B in FIG. 9; this view illustrates an ink discharge surface wiping state during the recovery of the printer shown in FIG. 9.

If apparatus body 62 is then moved in the E1 direction, guide pins 66*a*, 66*b* are moved along the cam groove region Sb of guide groove 69*c*l, wipers 65*a*, 65*b*, 65*c* are moved, while maintaining contact with the ink discharge surface of head units 68*a*, 68*b*, 68*c*, and the ink discharge surface is wiped out and cleaned (state shown in FIG. 10D).

If apparatus body 62 is further moved in the E1 direction, guide pins 66*a*, 66*b* further move upward and reach the cam groove region Sc of guide groove 69*c*2. Cap members 63*a*, 63*b*, 63*c* are pushed upward by spring members 64*a*, 64*b*, 64*c* and brought in intimate contact with the ink discharge surface of head units 68*a*, 68*b*, 68*c* and cover the head units (state shown in FIG. 10E).

In the above-described state, ink is discharged into caps and clogging of nozzles is eliminated. In the printing stand-by mode, the above-described head units are maintained in a state in which they are covered with caps and nozzle drying is prevented.

If apparatus body 62 is thereafter moved in the E1 direction when printing is initiated, guide pins 66*a*, 66*b* descend, while being guided downward by tilted guide groove 69*d*, and both the wipers 65*a*, 65*b*, 65*c* and the cap members 63*a*, 63*b*, 63*c* are withdrawn from head units 68*a*, 68*b*, 68*c*. If then apparatus body 62 is reversibly moved in the direction opposite to the E1 direction, guide pins 66*a*, 66*b* move along guide grooves 69*e* in the lower position thereof, push up the switch catches 69*a* and recede and apparatus body 62 retracts from above transportation belt 18 (state shown in FIG. 10B).

Then, printer head 67 is lowered in the direction opposite to F1 direction to obtain a printing ready state (state shown in FIG. 10A).

Figure 10E:
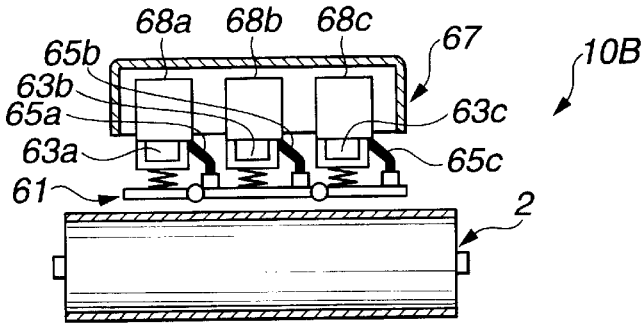
FIG. 10E is a cross-sectional view along B—B in FIG. 9; this view illustrates a capping state after ink discharge surface wiping during the recovery of the printer shown in FIG. 9.

In the above-described embodiment, recovery apparatus 61 is lowered from a state shown in FIG. 10E, in which the recovery operation has been completed, and returned into retracted position. However, in distinction to such retraction operation, recovery apparatus 61 may be returned into retracted position shown in FIG. 10B by sliding it from the raised position in the direction opposite to the E1 direction. In this case, head unit cleaning with wipers can be conducted again in the above-described return movement process.

With printer 10B of the above-described third embodiment, the recovery treatment is conducted by merely moving the printer head in the vertical direction and inserting the recovery apparatus 61 from the side of transportation belt to below the printer head and the structure surrounding the printer head is simplified. Furthermore, the traveling distance of the recovery apparatus may be decreased by comparison with the distance traveled by the recovery apparatus when it is inserted and retracted along the paper transportation direction.

Furthermore, cleaning of the ink discharge surfaces of a plurality of head units can be conducted effectively by inserting recovery apparatus 61 and/or moving it during retraction. Moreover, since the head units are covered with caps immediately after the cleaning operation, no useless operations are conducted. Further, the traveling distance of the recovery apparatus may be decreased by comparison with the distance traveled by the recovery apparatus when it is inserted and retracted from the side along the paper transportation direction.

The printer of the fourth embodiment of the present invention will be described below.

Figure 13A:
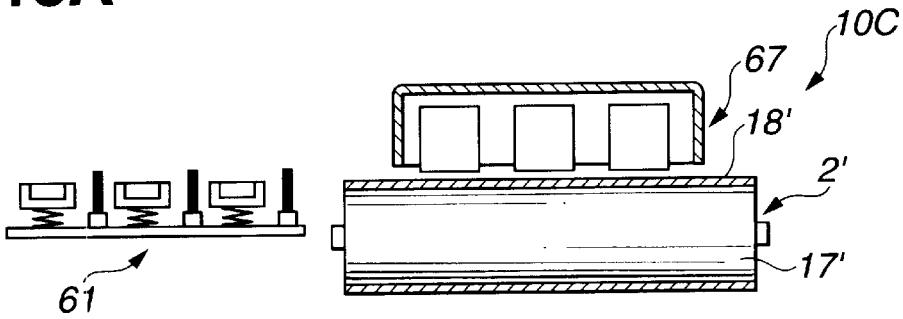
FIG. 13A is a longitudinal sectional view along the paper width direction illustrating the recovery operation process of the printer which is the fourth embodiment of the present invention; this figure shows a state in which the recovery apparatus is retracted in a printing stand-by mode or printing ready mode.
Figure 13B:
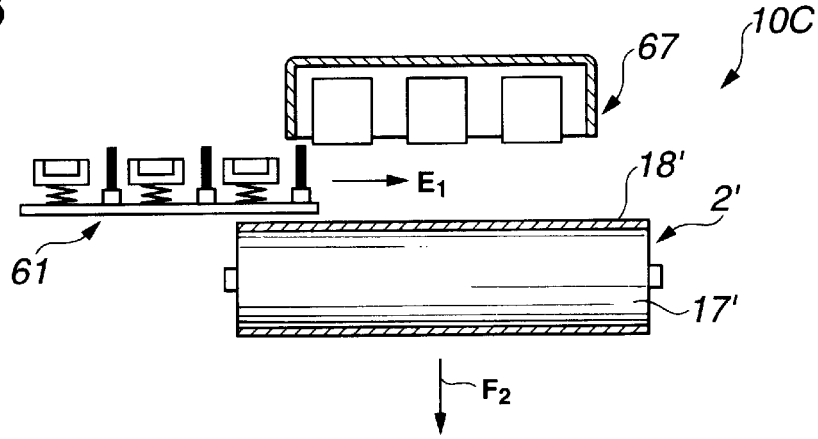
FIG. 13B is a longitudinal sectional view along the paper width direction illustrating the recovery operation process of the printer which is the fourth embodiment of the present invention; it shows the recovery operation state.
Figure 14A:
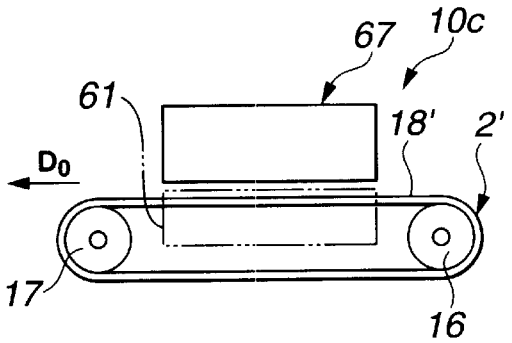
FIG. 14A is a side view from the paper width direction illustrating the recovery operation process of the printer shown in FIGS. 13A, B; this figure shows a state in which the recovery apparatus is retracted in a printing stand-by mode or printing ready mode.
Figure 14B:
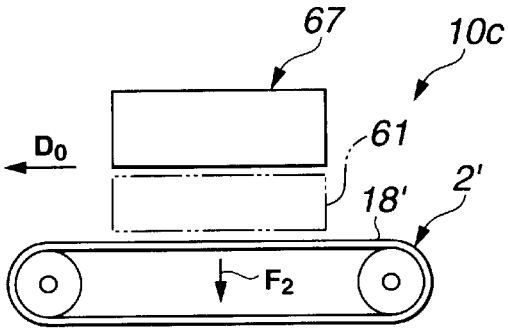
FIG. 14B is a side view from the paper width direction illustrating the recovery operation process of the printer shown in FIGS. 13A, B; it shows the recovery operation state.

FIGS. 13A, B are longitudinal sections along the paper width direction illustrating the recovery treatment process in a printer 10C of the fourth embodiment. FIG. 13A shows a state in which the recovery apparatus is retracted in a printing stand-by mode or printing ready mode. FIG. 13B shows a state in which paper transportation means is moved in the direction of withdrawal from the head and the recovery apparatus is inserted under the printer head. FIGS. 14A, B are side views from the paper width direction also illustrating the recovery treatment process of printer 10C of the fourth embodiment. FIG. 14A shows a printing ready state in which the recovery apparatus is retracted. FIG. 14B shows a state during recovery treatment operation in which paper transportation means is moved in the direction from the head and the recovery apparatus is inserted under the printer head.

The difference between printer 10C of the present embodiment and printer 10B of the above-described third embodiment is in that printer head 67 does not move upward and a paper transportation system 2', which is paper transportation means, can move together with transportation belt 18' and roller 17' in the downward F2 direction. Similarly to the above-described third embodiment, recovery apparatus 61, which is recovery means, comprises wipers and caps, and can be inserted and retracted by sliding in the E1 direction parallel to the paper width direction E0 at the upper surface side of a transportation belt 18'. The movement trajectory during insertion and retraction has the same step-like shape. All other structure components are the same as in printed 10 described above.

The recovery treatment operation of printer 10C of the present embodiment having the above-described structure will be described below. When the recovery treatment is conducted, the entire paper transportation system 2' is lowered in the F2 direction, as shown in FIG. 13B, from the printing ready state shown in FIG. 13A, and the gap between printer head 67 and transportation belt 18' is widened.

Recovery apparatus 61 is inserted into the gap by sliding it in the E1 direction. Once it has been inserted through a certain distance, it is raised and the wipers are brought in contact with the ink discharge surface of printer head 67. Then, in the process of moving the recovery apparatus 61 in the E1 direction, the wipers wipe and clean the ink discharge surface of head units. In a state in which the head units are covered with caps, the ink is discharged into the caps. The operation after the recovery treatment, such as retraction of recovery apparatus 61, is the same as that of printer 10B of the third embodiment.

With printer 10C of the above-described fourth embodiment, the effect produced is the same as that of printer 10B of the third embodiment. In particular, it is not necessary to raise or lower the printer head 67 and the structure of printer head and surrounding components becomes simple.

The printer of the fifth embodiment of the present invention will be described below.

Figure 15A:
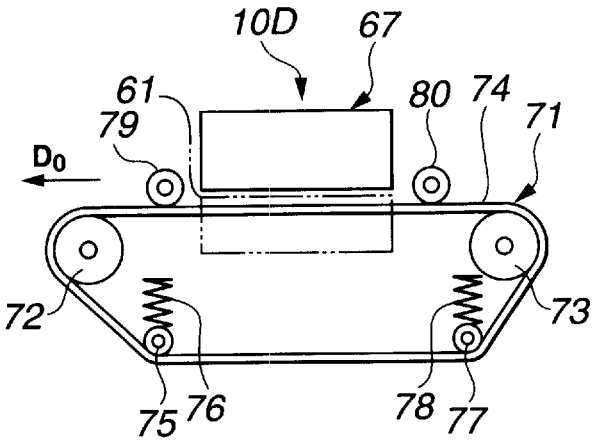
FIG. 15A is a side view from the paper width direction illustrating the recovery operation process of the printer which is the fifth embodiment of the present invention; this figure shows a state in which the recovery apparatus is retracted in a printing stand-by mode or printing ready mode.
Figure 15B:
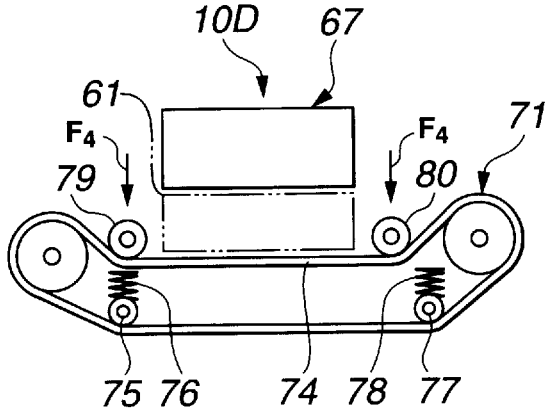
FIG. 15B is also a side view from the paper width direction illustrating the recovery operation process of the printer which is the fifth embodiment of the present invention; it shows the recovery operation state.

FIGS. 15A, B are side views from the paper width direction illustrating the recovery treatment process in a printer 10D of the fifth embodiment. FIG. 15A shows a printing ready state in which the recovery apparatus is retracted. FIG. 15B shows a state during recovery treatment operation in which the recovery apparatus is inserted under the printer head.

The difference between printer 10D of the present embodiment and printer 10B of the above-described third embodiment is in that printer head 67 does not move upward and a transportation belt 74 of a paper transportation system 71, which is paper transportation means, can move in the F4 direction. Similarly to the above-described third embodiment, recovery apparatus 61, which is recovery means, comprises wipers and caps, and can be inserted and retracted by sliding in the E1 direction (see FIG. 9) parallel to the paper width direction E0 at the upper surface side of transportation belt 74. The movement trajectory during insertion and retraction thereof has the same step-like shape. All other structure components are the same as in printer 10 described above.

Paper transportation system 71 comprises a drive roller 72, an idle roller 73, and transportation belt 74. Furthermore, it also comprises a pair of movable rollers 79, 80 which are the first rollers that can move in the F4 direction (downward) to the end position of the range of printer head 67 at the upper surface side which is the paper transportation surface side of transportation belt 74, and a pair of movable rollers 75, 77 which are second rollers that can move in the vertical direction and apply downward pressure to transportation belt 74 from the inner surface thereof.

Movable rollers 79, 80, 75, 77 are guided by respective guide openings (not shown in the figures) in the vertical direction. Movable rollers 75, 77 are under a downward force applied by springs 76, 78. Movable rollers 79, 80 are driven in the F4 direction by a roller drive mechanism (not shown in the figures).

The recovery treatment operation of printer 10D of the present embodiment having the above-described structure will be described below. When the recovery treatment is conducted, movable rollers 79, 80 are shifted in the F4 direction, as shown in FIG. 15B, from the printing ready state shown in FIG. 15A, transportation belt 74 present in the range between movable rollers 79, 80 is moved downward, and the gap under printer head 67 is widened. At this time, movable rollers 75, 77 move in the direction opposite to the F4 direction, that is, in the direction of approach to printer head 67, while compressing the springs 76, 78, and tension adjustment is conducted so as to maintain constant the perimeter length of transportation belt 74 in the transportation direction.

Recovery apparatus 61 is inserted into the gap that was formed under printer head 67 by sliding in the E1 direction (direction parallel to the paper width direction E0, see FIG. 9) perpendicular to the transportation direction D0. Once it has been inserted through a certain distance, it is raised and the wipers are brought in contact with the ink discharge surface of printer head 67. The sequence of operations of cleaning the ink discharge surface of head units with wipers in the process of moving the recovery apparatus 61, covering the head units with caps, discharging the ink, and retracting the recovery apparatus 61 upon completion of recovery treatment are identical to those in printer 10B of the third embodiment.

With printer 10D of the above-described fifth embodiment, the effect produced is the same as that of printer 10B of the third embodiment. In particular, it is not necessary to raise or lower the printer head 67 and the structure of printer head and surrounding components becomes simple.

The printer of the sixth embodiment of the present invention will be described below.

Figure 16A:
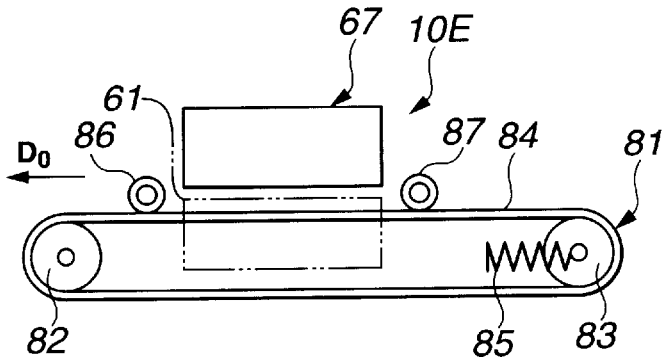
FIG. 16A is a side view from the paper width direction illustrating the recovery operation process of the printer which is the sixth embodiment of the present invention; this figure shows a state in which the recovery apparatus is retracted in a printing stand-by mode or printing ready mode.
Figure 16B:
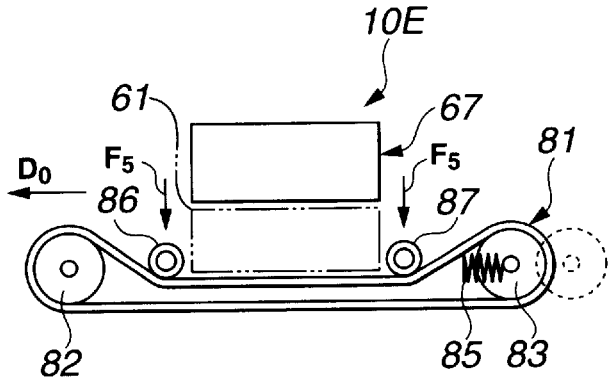
FIG. 16B is also a side view from the paper width direction illustrating the recovery operation process of the printer which is the sixth embodiment of the present invention; this figure shows the recovery operation state.

FIGS. 16A, B are side views from the paper width direction illustrating the recovery treatment process in a printer 10E of the sixth embodiment. FIG. 16A shows a state in which the recovery apparatus is retracted in a printing stand-by mode or printing ready mode. FIG. 16B shows a state during recovery treatment operation in which the recovery apparatus is inserted under the printer head.

The difference between printer 10E of the present embodiment and printer 10B of the above-described third embodiment is in that printer head 67 does not move upward and an idle roller 83 of a paper transportation system 81, which is paper transportation means, can move in the D0 direction (transportation direction) and the transportation surface of transportation belt 84 can move in the F5 direction (up and down direction). Similarly to the above-described third embodiment, recovery apparatus 61, which is recovery means, comprises wipers and caps and can be inserted and retracted by sliding in the E1 direction (see FIG. 9) parallel to the paper width direction E0 at the upper surface side of transportation belt 84. The movement trajectory during insertion and retraction thereof is the same as in the third embodiment. All other structure components are the same as in the second embodiment.

Paper transportation system 81 comprises a drive roller 82, an idle roller 83, and transportation belt 84. Furthermore, a pair of movable rollers 86, 87 that can move in the F5 direction (downward) to the end position of the range of printer head 67 are installed at the upper surface side which is the paper transportation surface of transportation belt 84. Furthermore, idle roller 83 is supported so that it can slide in the D0 direction, which is the transportation direction, and a spring 85 applies a force thereto in the direction opposite to the D0 direction.

The recovery treatment operation of printer 10E of the present embodiment having the above-described structure will be described below. When the recovery treatment is conducted, movable rollers 86, 87 are shifted in the F5 direction, as shown in FIG. 16B, from the printing ready state shown in FIG. 16A, transportation belt 84 present in the range between the movable rollers 86, 87 is moved downward, and the gap under printer head 67 is widened. At this time, idle roller 83 is moved in the D0 direction, while compressing the spring 85, and tension adjustment is conducted so as to maintain constant the perimeter length of transportation belt 84 in the transportation direction.

Recovery apparatus 61 is inserted into the gap under the printer head 67 by sliding in the E1 direction (FIG. 9), which is parallel to the paper width direction E0. Once it has been inserted through a certain distance, it is raised and the wipers are brought in contact with the ink discharge surface of printer head 67. The sequence of operations of cleaning the ink discharge surface of head units with wipers in the process of moving the recovery apparatus 61, covering the head units with caps, discharging the ink, and retracting the recovery apparatus 61 upon completion of recovery treatment are identical to those in printer 10B of the third embodiment.

With printer 10E of the above-described sixth embodiment, the effect produced is the same as that of printer 10B of the third embodiment. In particular, it is not necessary to raise or lower the printer head 67 and the structure of printer head and surrounding components becomes simple.

Modifications of the recovery apparatus comprising caps that are cap means and wipers that are wiper means, which was employed in printers 10B–10E of the above-described third to sixth embodiments will be described below.

Figure 17:
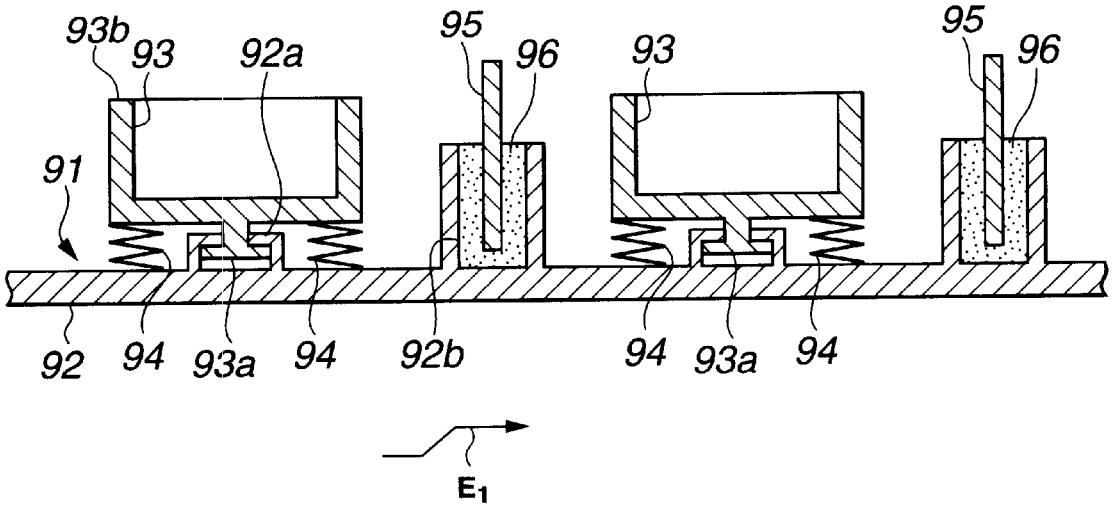
FIG. 17 is a longitudinal sectional view along the insertion direction of caps and wipers in the modification of the recovery apparatus in the printer of the third to sixth embodiments.

FIG. 17 is a longitudinal section along the insertion direction (E1) illustrating surrounding of caps and wipers in the recovery apparatus which is one of the modifications. In a recovery apparatus 91 of this modification, a plurality of pairs of caps 93 and wipers 95 are disposed on an apparatus body 92. The wipers are disposed adjacent to respective caps in the E1 direction.

Cap 93 is cap means capable of covering the discharge opening on an ink discharge surface of a head unit. The cap comprises a protrusion 93*a* at the lower portion thereof. Protrusion 93*a* is engaged with a stopper 92*a* of apparatus body 92 and controls the upward movement of cap 93. Furthermore, springs 94 apply pressure to the bottom surface of cap 93 on both sides thereof so that the cap can swing.

Therefore, when recovery apparatus 91 is inserted under the printer head and the upper surface 93*b* of cap 93 is brought in contact with the ink discharge surface of head unit, the cap 93 is tilted with respect to the ink discharge surface. As a result, the upper surface 93*b* of cap 93 can be tightly pressed against the ink discharge surface.

Wiper 95 is wiping means which a flexible part that wipes the ink discharge surface by sliding in a state of elastic deformation and is supported on a wiper mounting portion 92*b* of apparatus body 92 via a spongy ink-absorbing body 96. The ink which is wiped when the ink discharge surface is wiped with wiper 95 is absorbed by ink-absorbing body 96.

The recovery treatment by recovery apparatus 91 of the present modification having the above-described structure is conducted similarly to the recovery treatment by recovery apparatus 61 of the second embodiment by inserting the recovery apparatus in the E1 direction under the printer head, wiping the ink discharge surface of the head unit with wipers 95, while moving the recovery apparatus in a step-like manner, capping the ink discharge surface of head units with caps 93, and discharging the ink.

With recovery apparatus 91 of the present modification the cap 93 can be reliably and tightly pressed against the ink discharge surface of head unit and at the same time the ink wiped out by wipers 95 can be effectively absorbed by ink-absorbing body 96.

Figure 18A:
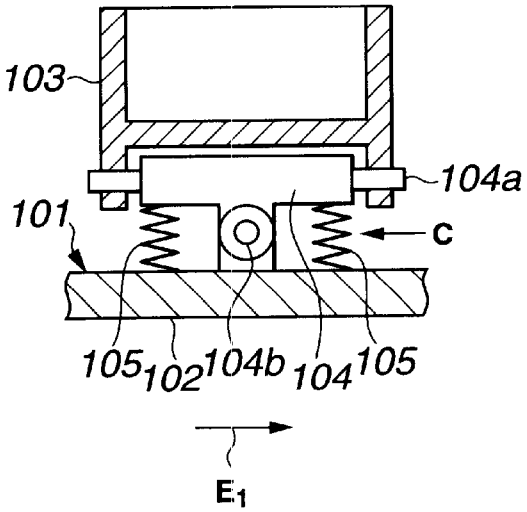
FIG. 18A is a longitudinal sectional view of a cap of another modification of the recovery apparatus in the printer of the third to sixth embodiments.
Figure 18B:
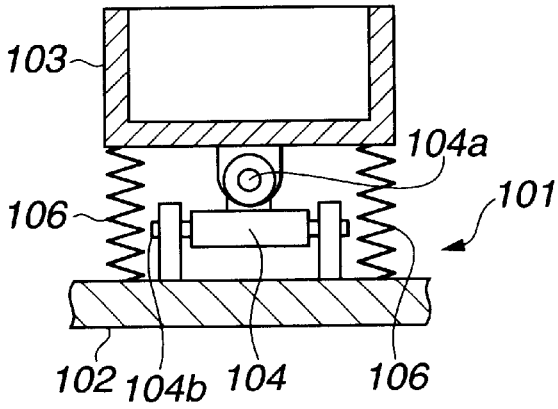
FIG. 18B is a view along arrow C in FIG. 18A.

FIGS. 18A, B illustrate a cap portion of a recovery apparatus which is another modification. FIG. 18A is a longitudinal section along the E1 direction which is the insertion direction, and FIG. 18B is view along arrow C in FIG. 18A.

A cap 103 provided in a recovery apparatus 101 of this modification is supported so that it can swing on two axis which are perpendicular to each other. Thus, cap 103 is supported so that it can rotate on a support shaft 104*a* which follows the parallel insertion direction E1. A support body 104, in which the support shaft 104*a* is formed, further has a support shaft 104*b* perpendicular to support shaft 104*a*, and the support shaft 104*b* is supported so that it can swing on apparatus body 102.

Therefore, cap 103 is supported with respect to apparatus body 102 by support shafts 104*a* and 104*b* which are perpendicular to each other. Therefore, it is supported so that can be easily tilted in any direction. Furthermore, two springs 105 installed at the end portions of support shaft 104*a* of support body 104 apply an upward force, and at the same time two springs 106 apply an upward force to the end portions of bottom surface of apparatus body 102 at the sides of support shaft 104*a*.

If cap 103 is inserted under the head unit and brought in contact with the ink discharge surface thereof, the end surface of cap 103 can be tilted following the ink discharge surface and tightly pressed against the ink discharge surface by the forces applied by springs 105, 106.

With recovery apparatus 101 of this modification, cap 103 is supported so that it can easily rotate with respect to the recovery apparatus body. Therefore, it can be more reliably pressed against the ink discharge surface of head unit.

Figure 19:
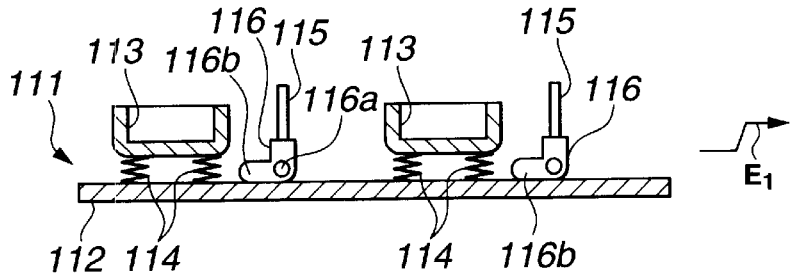
FIG. 19 is a longitudinal sectional view along the insertion direction of caps and wipers in still another modification of the recovery apparatus in the printer of the third to sixth embodiments.
Figure 20A:
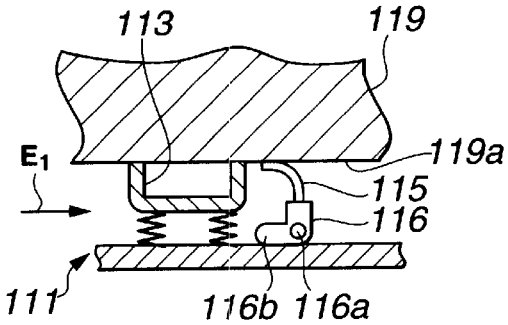
FIG. 20A is a cross-sectional view illustrating the recovery operation state of caps and wipers in the modification shown in FIG. 19; this figure shows a state of wiping operation.
Figure 20B:
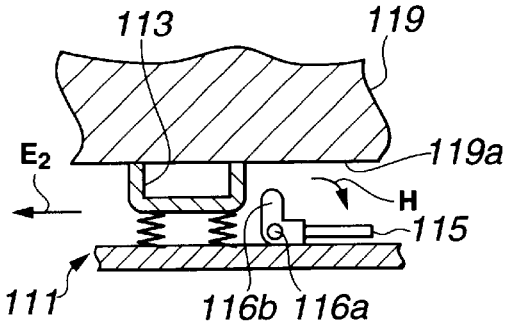
FIG. 20B is a cross-sectional view of the wiper in the modification shown in FIG. 19; this figure shows a state in which the wiper is tilted.

FIG. 19 is a longitudinal sectional view along the insertion direction (E1) of the cap and wiper surrounding in a recovery apparatus of still another modification. FIGS. 20A, B are cross-sectional views illustrating the recovery treatment operation state of the recovery apparatus. FIG. 20A illustrates a state in which the ink discharge surface is wiped with a wiper, and FIG. 20B illustrates a state in which the wiper is tilted.

In a recovery apparatus 111 of this modification, a plurality of pairs of caps 113 and wipers 115 are disposed on an apparatus body 112. The wipers are disposed adjacent to respective caps at the side thereof in the E1 direction.

Cap 113 is capping means that can cover the ink discharge surface of head unit and is supported in a state in which an upward force is applied thereto by springs 114.

Wiper 115 is wiping means which is a flexible part wiping the ink discharge surface by sliding in an elastically deformed state. The wiper is supported by support shaft 116*a* so that it is free to rotate with respect to apparatus body 112. An end portion of the wiper is fixedly mounted in an L-shaped wiper support 116 constituting the wiping means retraction mechanism. Wiper support 116 can be rotatably driven by a wiper rotation drive mechanism (not shown in the figures).

The recovery treatment operation conducted by recovery apparatus 111 is conducted similarly to recovery treatment conducted by recovery apparatus 61 in the above-described second embodiment by inserting the apparatus under the printer head from the side thereof in the E1 direction and moving the apparatus in a step-like fashion. Thus, when recovery apparatus 111 is inserted under the head unit, as shown in FIG. 20A, the front end 116*b* of the L-shaped wiper support is brought in contact with apparatus body 112 and the ink discharge surface of head unit 119 is wiped with the deformed front end of wiper 115 that is in the vertical position.

Once the wiping operation has been completed, the wiper support 116 is rotated clockwise in the H direction by the wiper rotation drive mechanism and wiper 115 is tilted in the lateral direction as shown in FIG. 20B. In such wiper tilted state in which wiping cannot be conducted, recovery apparatus 111 can be retracted in the E2 direction (direction opposite to E1 direction). Furthermore, the step-like link shape can be simplified.

With recovery apparatus 111 of the present modification, wiper 115 is rotatably supported by wiper support 116. Therefore, when recovery apparatus 111 is inserted, the ink discharge surface is wiped by the wiper, and when the recovery apparatus is retracted, the wiper is tilted and can be moved so that the ink discharge surface is not wiped.

Figure 21A:
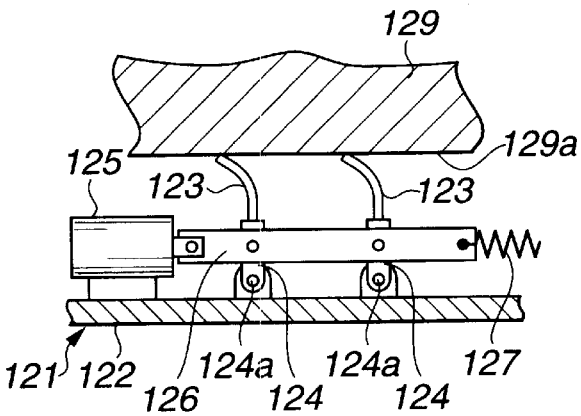
FIG. 21A is a longitudinal sectional view along the insertion direction illustrating the surrounding of a wiper drive mechanism which is still another modification incorporated in the recovery apparatus in the printer of the third to sixth embodiments; this figure shows a state in which the ink discharge surface is wiped with a wiper.
Figure 21B:
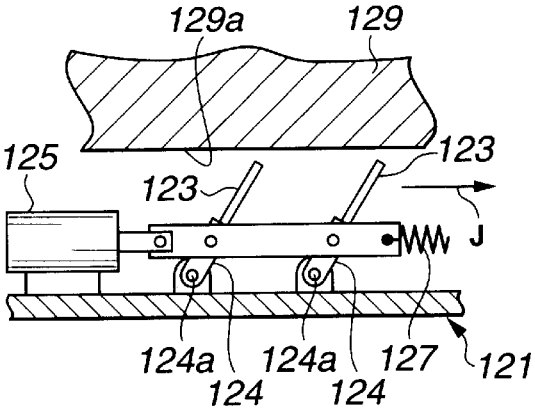
FIG. 21B is a longitudinal sectional view along the insertion direction illustrating the surrounding of a wiper drive mechanism of the modification shown in FIG. 21A; this figure shows a state in which the wiper is tilted and separated from the ink discharge surface.

FIGS. 21A, B are longitudinal sectional views along the insertion direction (E1) illustrating the surrounding of the wiper drive mechanism unit incorporated into the recovery apparatus of still another modification. FIG. 21A illustrates a state in which the ink discharge surface is wiped with the wiper, and FIG. 21B illustrates a state in which the wiper is tilted and withdrawn from the ink discharge surface.

In a recovery apparatus 121 of the present modification, a plurality of wipers 123 corresponding to head unit 129 are driven into a vertical position in which wiping can be conducted and into tilted position retracted from the position in which wiping can be conducted via a solenoid 125 and a link part constituting the wiping means retraction mechanism.

Wiper 123 is installed on a wiper support 124 of the link part which is rotatably supported via a support shaft 124*a* on an apparatus body 122. Wiper supports 124 are connected to a drive rod 126 linked to a magnetic core of solenoid 125. If solenoid 125 is turned on and the magnetic core is drawn in, wiper supports 124 assume a vertical position, as shown in FIG. 21A, and wipers 123 rise into a position in which wiping of ink discharge surface 129*a* can be conducted. When solenoid 123 is turned off, the magnetic core is loosened, as shown in FIG. 21B, and drive rod 126 is moved in the J direction by the force applied by spring 127. As a result, wiper support 124 and wiper 123 are tilted and wiper 123 is withdrawn from ink discharge surface 129*a*.

With recovery apparatus 121 of the present modification, turning the solenoid 125 on and off makes it possible to move wiper 123 with respect to ink discharge surface 129*a* from the position in which wiping can be conducted to a retracted position and wiping of the ink discharge surface can be freely controlled.

Figure 22:
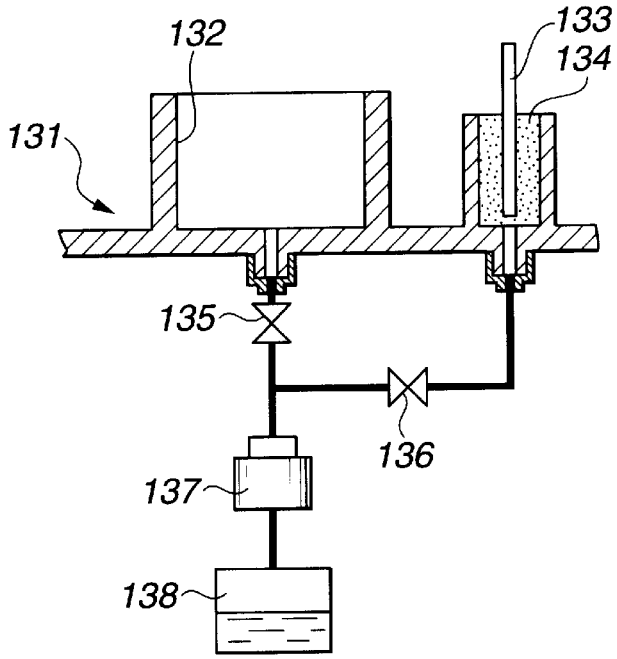
FIG. 22 is a schematic view of a longitudinal section along the insertion direction illustrating caps and wipers in still another modification of the recovery apparatus in the printer of the third to sixth embodiments.

FIG. 22 is a schematic longitudinal sectional view along the insertion direction (E1) illustrating the surrounding of cap and wiper of the recovery apparatus of yet another embodiment.

In a recovery apparatus 131 of the present embodiment, a cap 132 which is capping means and a wiper 133 which is flexible wiping means held in an ink-absorbing body 134 are disposed on the apparatus body. Furthermore, a drain tube is connected to cap 132 and ink-absorbing body 134. The discharged ink and absorbed ink can be drained into a drain tank 138 via normally closed valves 135, 136 and drain pump 137.

The recovery treatment operation of recovery apparatus 131 of the present modification having the above-described configuration is conducted similarly to recovery treatment with recovery apparatus 61 in the above-described third embodiment by inserting the apparatus under the printer head in the E1 direction and moving the apparatus in a step-like fashion. In this process, the ink discharge surface of head unit is wiped with wiper 133, the ink discharge surface of head unit is covered with cap 132, and in this state the ink is discharged.

The ink wiped out when the ink discharge surface was wiped with wiper 133 is absorbed by ink-absorbing body 134. Furthermore, the discharged ink remains inside cap 132. When the amount of ink absorbed by ink-absorbing body 134 reaches an absorption limit, or if the cap is filled up with the ink, the normally closed valve 135 or 136 is opened, the drain pump 137 is activated, and the ink is released into drain tank 138.

With recovery apparatus 131 of the present modification having the above-described structure, the ink remaining in cap 32 or ink-absorbing body 134 can be effectively guided into drain tank 138. Therefore, the ink-absorbing body does not overabsorb the ink and dripping does not occur.

FIGS. 23A–D illustrate the structures of wipers which are wiping means of the recovery apparatuses of various modifications.

Figures 23A, 23B, 23C:
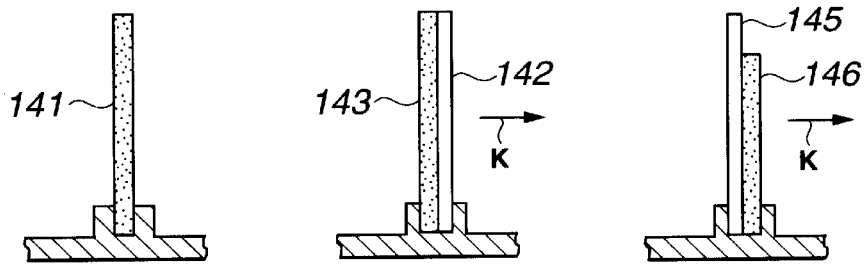
FIG. 23A is a longitudinal sectional view along the insertion direction illustrating a wiper in still another modification of the recovery apparatus in the printer of the third to sixth embodiments.
FIG. 23B is a longitudinal sectional view along the insertion direction illustrating a wiper in yet another modification of the recovery apparatus in the printer of the third to sixth embodiments.
FIG. 23C is a longitudinal sectional view along the insertion direction illustrating a wiper in still another modification of the recovery apparatus in the printer of the third to sixth embodiments.

The wiper structure shown in FIG. 23A is the simplest among them; in this structure a flexible wiper 141 capable of absorbing ink is provided on the apparatus body. The ink absorbed by wiper 141 is drained into the drain tank via a drain pump. With such structure, the configuration is simple and ink absorption can be effectively conducted by the wiper.

In the wiper structure shown in FIG. 23B, a sponge-like ink-absorbing body 143 is pasted to the rear surface, in the sliding direction (K direction), of wiper 142. Ink-absorbing body 143 and wiper 142 have the same height. The ink absorbed by ink-absorbing body 143 is drained into a drain tank via a drain pump. With such structure, the ink wiped with wiper 142 is immediately absorbed by ink-absorbing body 143. Therefore, wiping with good cleaning efficiency is conducted.

In the wiper structure shown in FIG. 23C a sponge-like ink-absorbing body 146 is pasted to the side of wiper 145 in the sliding direction (K direction). Ink-absorbing body 146 is slightly lower than wiper 145. The ink absorbed by ink-absorbing body 146 is drained into a drain tank via a drain pump. With such structure, the ink wiped with wiper 145 flows downward under gravity and is immediately absorbed by ink-absorbing body 146. Therefore, wiping with good cleaning efficiency is conducted. Furthermore, ink-absorbing bodies 146 may be provided on the side in the sliding direction and also on the rear surface.

Figure 23D:
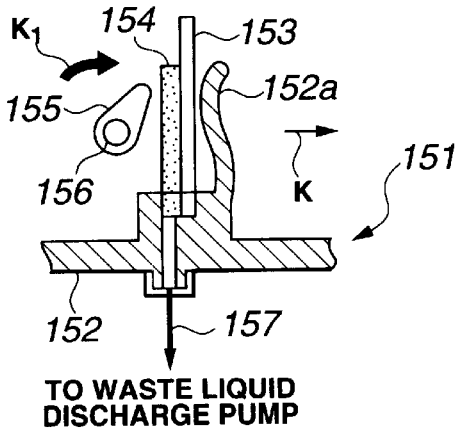
FIG. 23D is a longitudinal sectional view along the insertion direction illustrating a wiper in yet another modification of the recovery apparatus in the printer of the third to sixth embodiments.

In the wiper structure shown in FIG. 23D a sponge-like ink-absorbing body 154 is pasted to the rear surface, in the sliding direction (K direction), of wiper 153 and a wiper contact tab 152*a* which protrudes from apparatus body 152 and can be brought in contact with the side surface of wiper 153 is provided in the central portion at the sliding direction (K direction) side. Furthermore, an absorbing body pressure tab 155 which is supported by a support shaft 156 and can rotate in the K1 direction is provided in a position opposite the ink-absorbing body 154.

With the wiper structure having the above-described configuration, the ink wiped by wiper 153 and absorbed by ink-absorbing body 154 is squeezed out downward by rotation of absorbing body pressure tab 155 and guided into a drain pipe 157. Then, it is guided into a drain tank via a drain pump. With such wiper structure, the ink absorbed by ink-absorbing body 154 is squeezed out and drained reliably. Therefore, the absorption capacity of ink-absorbing body is maintained and good wiping effect can be constantly obtained.

The printer of the seventh embodiment of the present invention will be described below.

Figure 24:
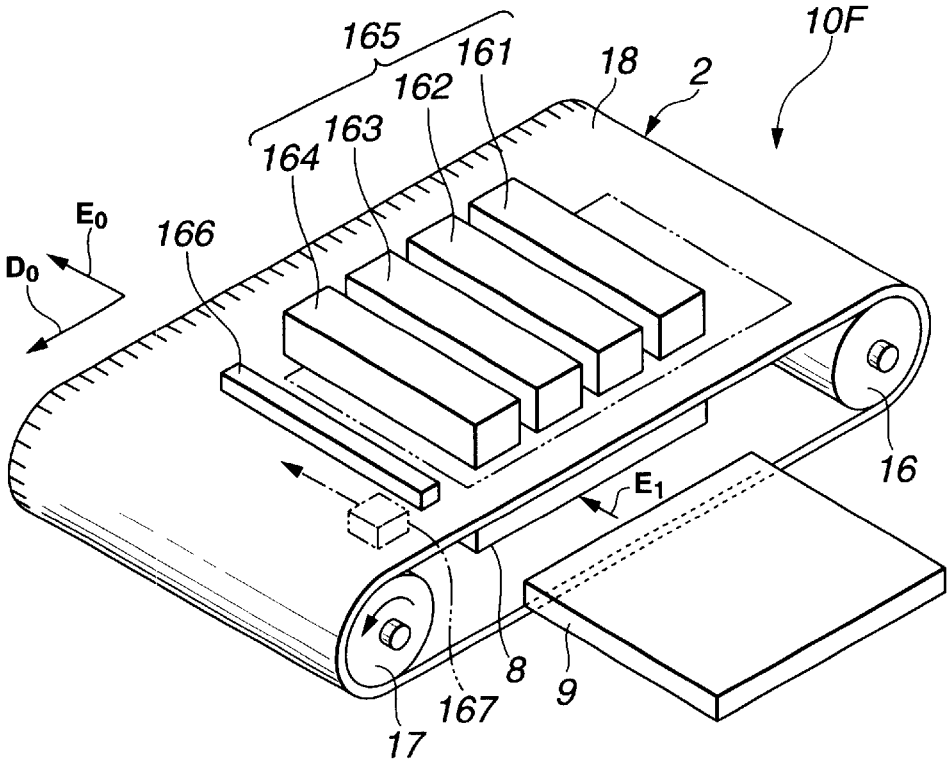
FIG. 24 is a perspective view illustrating the appearance of the main portion of the printer which is the seventh embodiment of the present invention.
Figure 25:
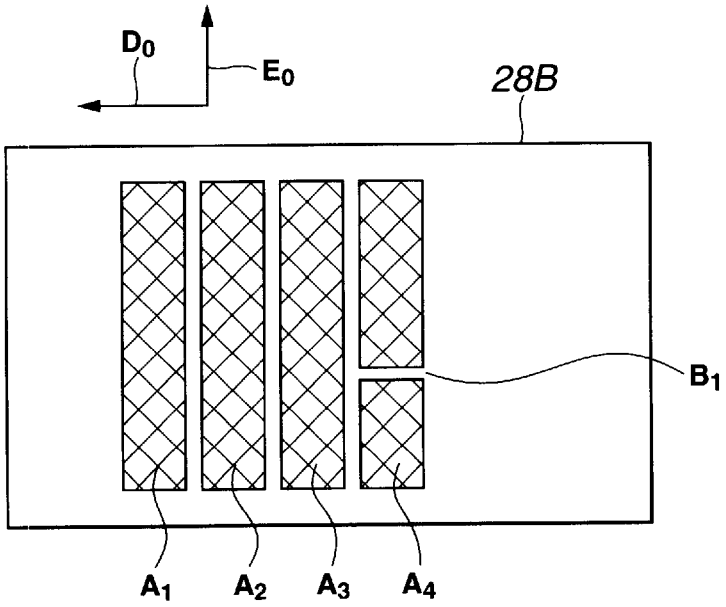
FIG. 25 illustrates a test print sample printed with the printer shown in FIG. 24.

FIG. 24 is a perspective view illustrating the appearance of the main portion of printer 10F of the seventh embodiment. FIG. 25 is a test printer sample printed with the printer.

Printer 10F of this embodiment comprises a printer head 165, a test print sensor 166, paper transportation system 2, suction apparatus, 8, and recovery apparatus 9 similar to those employed in the second embodiment, sensors such as belt speed and position detection sensors, drive motor, head controller, printing control means (not shown in the figures), and the like.

Printer head 165 is, for example, composed of black, yellow, magenta, and cyan head blocks 161, 162, 163, 164 which are monochromatic head blocks representing modifications shown in FIG. 6. The head blocks may employ the printer head 3 which were used in the second embodiment and in which head units for each color are disposed along the tilted line.

Test print sensor 166 is composed of a line sensor capable of detection in dot units, without scanning in the paper width direction, of a test print solidly printed by ink droplet discharge on the paper printing width range. A photo-reflector 167 detecting the solid print state in dot units by scanning in the paper width direction can be employed instead of the test print sensor 166.

In printer 10F of the present embodiment having the above-described configuration, the test printing is conducted prior to printing operation or when abnormal printing such as lack of printing dots has been recognized. In the test printing, color-separated solid printing of preset width is conducted with head blocks 161, 162, 163, 164 of respective colors, and a test print sample 28B (shown in FIG. 25) with four print patterns A1, A2, A3, A4 corresponding to head blocks of respective colors is obtained. This test print sample is transported with transportation belt 18, the printing state thereof is detected with test sample sensor 166, and printing defects such as white stripes, which are due to lack of dots, are detected.

For example, when test print sample 28B is obtained, the white stripe B1 of print pattern A4 is detected by test print sensor 166. Therefore, CPU detects an abnormal printing state in which one of the nozzles in head block 164 corresponding to B1 is clogged.

Then, a recovery treatment for recovery of the abnormal printing state is executed by command from CPU, but first the recovery apparatus 9 is brought closer to transportation belt 18 in the E1 direction and moved in the position above the transportation belt 18 and under the printer head 165, in which the recovery treatment can be executed.

Here, ink is discharged from the nozzle of the head block that produced the printing defect toward the recovery apparatus 9 and clogging of the nozzle is eliminated. For example, when the test print sample 28B shown in FIG. 25 was obtained, the recovery treatment is conducted by discharging ink from the nozzle of head block 164.

Then, recovery apparatus 9 is moved in the direction opposite to the E1 direction, withdrawn to the side of transportation belt 18, and set into a printing ready state. If the printing defect is not eliminated despite the recovery treatment, the respective head unit shown in FIG. 6 or FIG. 4 is pulled out from head support substrate 49 or head support substrates 41, 42 and simply replaced with a quality head block.

With printer 10F of the above-described seventh embodiment, a convenient-to-use printer can be provided in which the abnormal printing state of printer head 165 is detected, ink is discharged only from the respective head block, and the printing function is automatically recovered.

A modification of the head block constituting the printer head employed in printer 10F of the seventh embodiment will be described below.

Figure 26:
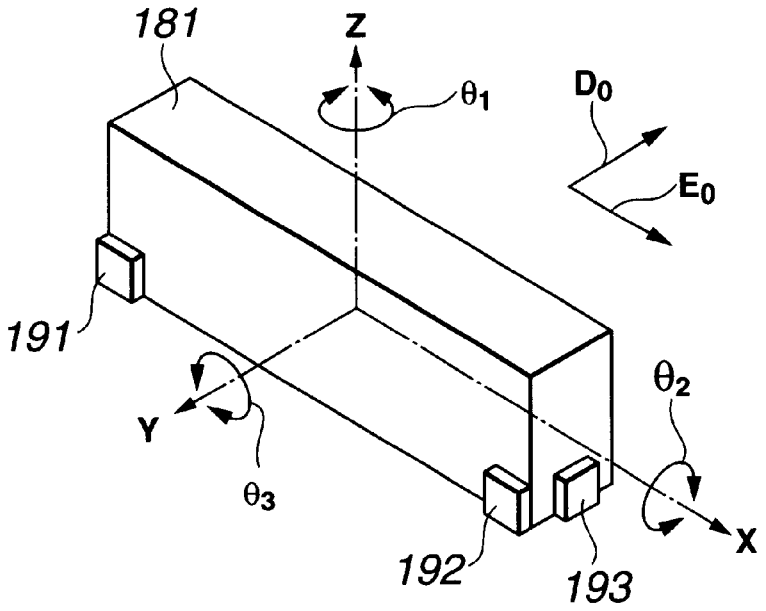
FIG. 26 is a perspective view of a modification of a head block constituting the printer head of the printer shown in FIG. 24.

FIG. 26 is a perspective view of the head block of this modification. A head block 181 of this modification comprises a plurality of ink discharge openings inside thereof and is supported in a state in which is can be moved by very small steps in the X axis direction and Y axis direction via the below-described actuators 191, 192, and 193 with respect to the printer head body (not shown in the figures).

The X axis direction matches the paper width direction (E0 direction) and the Y axis direction matches the direction inverse to the paper transportation direction (D0 direction). The direction (vertical direction) perpendicular to X axis and Y axis is represented by a Z axis. Furthermore, the angle of rotation about the Z axis is denoted by θ1, the angle of rotation about the X axis is denoted by θ2, and the angle of rotation about the Y axis is denoted by θ3.

Actuators 191, 192 are composed of piezoelectric elements and installed on the wall surface in the Y axis direction at the end portions of the head block body in the X axis direction, so as to be between the head block body and printer body. Actuator 193 is also composed of a piezoelectric element; it is installed on the wall surface of the head block body in the X axis direction so as to be between the head block body and printer body.

Actuators 191, 192, 193 are employed as follows. If an error is made in positioning a nozzle of a head block with respect to the printer head body or in positioning a head block when the printer is assembled, the error amount is stored in a memory, and when printing is conducted, the actuators are driven to a preset amount based on the CPU control via the actuator drivers, the installation wall position of the head block is shifted by very small steps through the distance corresponding to the error amount data, and the error in nozzle or head block position is corrected.

Figure 27:
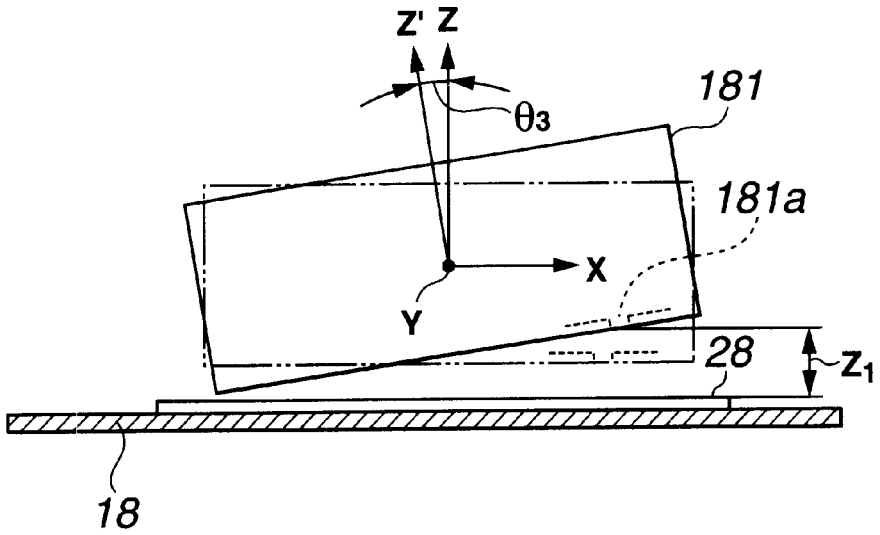
FIG. 27 is a side view illustrating the ink droplet discharge state when the head block of the modification shown in FIG. 26 is tilted about Y axis.

FIG. 27 illustrates an ink droplet discharge state when the Z axis direction of head block 181 is tilted in the Z' axis direction, that is, when it is tilted at an angle θ3 about the Y axis. In this state, since the direction of ink discharge from nozzle 181*a* is tilted at an angle 3, initially the zone on paper 28 which is reached by the ink droplet shifts in the X axis direction because the ink discharge direction is tilted as indicated above. At the same time, because the distance Z1 between the ink discharge surface and paper 28 changes depending on the position of head block 181 along the X axis, the ink droplet reaching timing changes and the position shifts in the Y axis direction.

The displacement in the X axis direction can be ignored for practical purposes and therefore requires no specially correction. By contrast, the displacement in the Y axis direction is also related to transportation speed and should be corrected. The displacement correction of timing at which the ink droplet reaches the paper can be conducted by rotating head block 181 in the θ1 direction by driving the actuators 191, 192. The corrected state of the head at this time is shown, for example, in the below-described FIG. 28A.

Figure 28A:
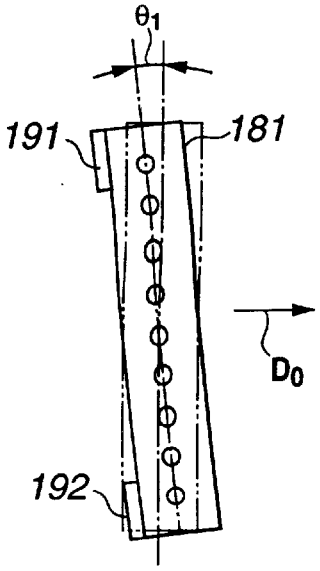
FIG. 28A is a schematic drawing illustrating the displacement of nozzle in the head block of the modification shown in FIG. 26, and this figure shows a state in which the nozzle is displaced in the direction of Z axis.

FIGS. 28A, B schematically illustrate the displacement in nozzle position of the head units assembled in a head block. FIG. 28A illustrates a case in which head block 181 is tilted at an angle θ1 about the Z axis. In this case, the displacement is corrected by driving the actuators 191, 192 and rotating the head block 181 in the opposite direction through the angle θ1.

Figure 28B:
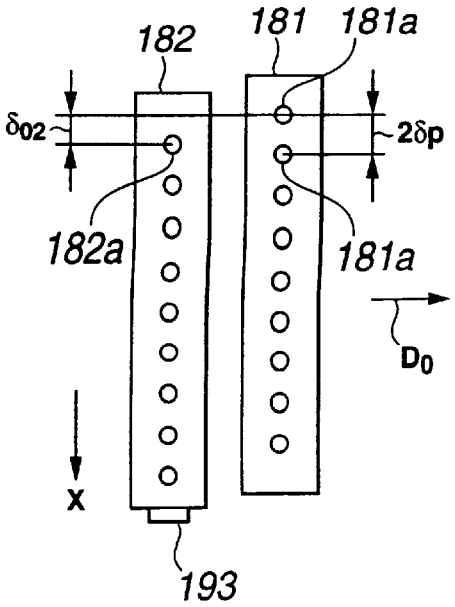
FIG. 28B is a schematic drawing illustrating the displacement of a nozzle in the head block of the modification shown in FIG. 26, and this figure shows a state in which the nozzle is displaced in the direction of X axis.

Furthermore, FIG. 28B illustrates a state in which a head block 182 is shifted in the X axis direction with respect to reference head block 181. Thus, the relative position δ02 of a nozzle 182*a* of head block 182 should correspond to half of the distance 2δP between the nozzles 181*a* of head block 181. When it is displaced, the position correction can be conducted by moving the head block 182 through the displacement distance in the X axis direction with actuator 193.

A modification using a timing control method for correcting the position and location of head blocks constituting the printer head of printer 10F of the seventh embodiment by the ink discharge timing control will be described below.

Figure 29A:
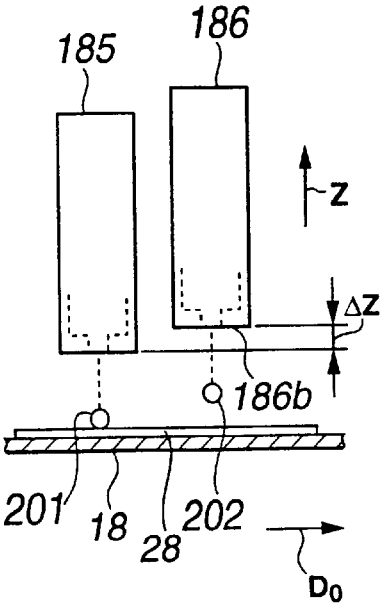
FIG. 29A is a side view from the paper width direction illustrating the ink droplet discharge state in a printer in which the timing control of ink discharge from the head block employed in the printer shown in FIG. 24 was modified, and this figure illustrates an ink droplet discharge state in which the head block was displaced in the vertical direction.

FIGS. 29A, B, C are side views of the head block employing the control method of the present modification which illustrate the ink droplet discharge state in the position and location of head blocks.

FIG. 29A illustrates an ink droplet discharge state in which a head block 186 is displaced by ΔZ in the Z axis direction (vertical direction) with respect to a reference head block 185. In this case, the distance between the ink discharge surface 186*b* of head block 186 and surface of paper 28 is increased by ΔZ. Therefore, an ink droplet 202 discharged from head block 186 reaches the paper surface with a delay in time corresponding to the distance ΔZ with respect to an ink droplet 201 discharged by reference head block 185.

Therefore, the printing dot position of ink droplet 202 relative to the printing dot position of reference ink droplet 201 will be displaced in the transportation direction, that is, the direction opposite to the D0 direction, with respect to the original relative position.

Timing control by CPU of discharge timing conducted so that the ink discharge timing of head block 182 is hastened by the time corresponding to distance ΔZ, with consideration for the transportation speed, in order to correct the displacement, makes possible the displacement-free printing.

Figure 29B:
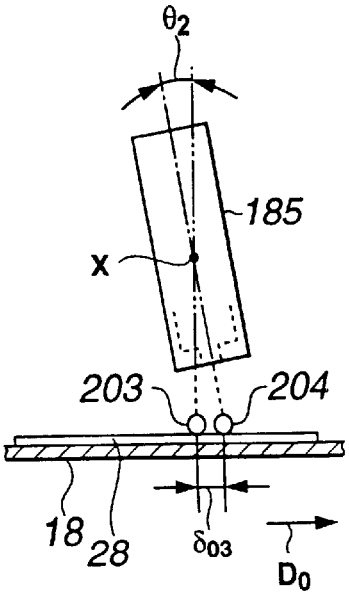
FIG. 29B is a side view from the paper width direction illustrating the ink droplet discharge state in a printer employing the modification of the ink discharge timing control shown in FIG. 29A, and this figure illustrates an ink droplet discharge state in which the head block was tilted.

FIG. 29B illustrates an ink droplet discharge state in which head block 185 is tilted in the Z axis direction (vertical direction), that is, tilted through a rotation angle θ2 about the X axis. In this case, the position on paper 28 which is reached by an ink droplet 204 discharged from the nozzle of the tilted head block 185 is displaced in the D0 direction at a distance δ03 from the position reached by an ink droplet 203 from the head block that was not tilted.

Timing control by CPU conducted so that the discharge timing is delayed by the time corresponding to distance δ03, with consideration for the transportation speed, in order to correct the displacement, makes possible the correction of the displacement caused by tilting.

Figure 29C:
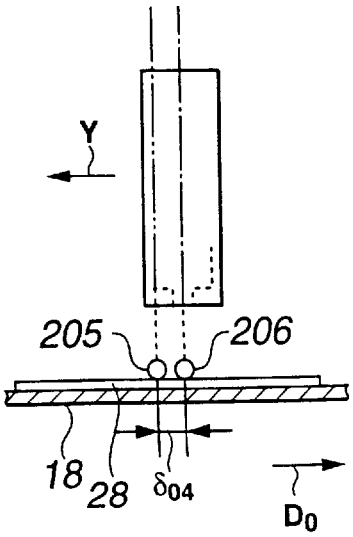
FIG. 29C is a side view from the paper width direction illustrating the ink droplet discharge state in a printer employing the modification of the ink discharge timing control shown in FIG. 29A, and this figure illustrates an ink droplet discharge state in which the head block was displaced in the transportation direction.

FIG. 29C illustrates an ink droplet discharge state in which head block 185 is displaced parallel to itself through a distance 604 in the −Y axis direction. In this case, the position on paper 28 which is reached by ink droplet 206 discharged from a nozzle of head block 185 is obviously displaced in the D0 direction at the distance 604 with respect to the position reached by an ink droplet 205 discharged from the head block that was not displaced.

Therefore, timing control by CPU conducted so that the discharge timing is delayed by the time corresponding to distance 604, with consideration for the transportation speed, in order to correct the displacement makes possible the correction of the displacement caused by such parallel movement.

As described above, the present invention can provide a printer conducting printing by discharging ink droplets from a plurality of nozzles, in which the recovery treatment of the ink discharge surface can be conducted easily, the recovery means has a simple structure, the increase in the printer size can be avoided, printer cost can be reduced, and adjustment, maintenance, and control can be conducted easily.

What is claimed is:

1. A printer comprising:

a printer head which is capable of conducting full-line printing on a printing paper without scanning in a width direction of said printing paper, and which is provided with a plurality of nozzles;

a transportation belt disposed opposite an ink discharge surface of said printer head for transporting said printing paper in a transportation direction perpendicular to the width direction of said printing paper;

printing control means for conducting printing by controlling discharge of fine ink droplets from said printer head synchronously with transportation of said printing paper; and recovery means for recovery of discharge function of said nozzles of said printer head, said recovery means being insertable and retractable with respect to said printer head in a lateral direction, wherein said transportation belt is retractable so as to expand a gap defined with respect to said printer head, and said recovery means is inserted into the gap and conducts a recovery treatment within a period from beginning of said insertion of said recovery means to completion of retraction.

2. The printer according to claim 1, wherein said transportation belt is movable in a direction of withdrawal away from said printer head.

3. The printer according to claim 2, wherein said transportation belt is retractable in the direction of withdrawal away from said printer head.

4. The printer according to claim 3, further comprising a pair of rollers disposed at a transportation surface of said transportation belt, and wherein retraction of said transportation belt is conducted by moving the pair of rollers in the direction of withdrawal away from said printer head.

5. The printer according to claim 3, wherein retraction of said transportation belt is conducted while maintaining a constant perimeter length of the transportation belt in the transportation direction.

6. The printer according to claim 1, wherein said recovery means is inserted toward a position facing said printer head when recovery treatment is executed, such that at least a portion of said recovery means is brought in contact with the ink discharge surface of said printer head.

7. The printer according to claim 6, wherein when said recovery means is inserted toward the position facing said printer head, said recovery means is moved in a manner such that a height thereof is changed in a step-like fashion.

8. The printer according to claim 6, wherein said recovery means comprises wiping means for coming in contact with and sliding along the ink discharge surface of said printer head to conduct wiping when said recovery means is inserted toward the position facing said printer head.

9. The printer according to claim 1, wherein said printer head comprises a plurality of head units each having nozzles capable of printing a preset width of sections into which a full line of said printing paper is divided, and said recovery means comprises a plurality of recovery units, each provided for a respective one of said head units.

10. The printer according to claim 1, wherein said recovery means comprises at least one recovery member.

11. The printer according to claim 1, further comprising a test print sensor which reads a print image printed on said printing paper, and wherein said printing control means detects an abnormality of discharge function of said nozzles of said printer head based on an output of said test print sensor and conducts control so that said recovery means conducts the recovery treatment only when said abnormality of discharge function is detected.

12. The printer according to claim 11, wherein said test print sensor is adapted to detect a full line of the print image.

13. The printer according to claim 1, wherein said lateral direction in which said recovery means is insertable and retractable with respect to said printer head is perpendicular to the transportation direction and parallel to a transportation surface of said transportation belt.

* * * * *